US009802065B2

(12) United States Patent
Zhou

(10) Patent No.: US 9,802,065 B2
(45) Date of Patent: Oct. 31, 2017

(54) ESCAPE CHUTE

(71) Applicant: Miaorong Zhou, Shanghai (CN)

(72) Inventor: Miaorong Zhou, Shanghai (CN)

( * ) Notice: Subject to any disclaimer, the term of this patent is extended or adjusted under 35 U.S.C. 154(b) by 311 days.

(21) Appl. No.: 13/975,366

(22) Filed: Aug. 25, 2013

(65) Prior Publication Data

US 2013/0333979 A1 Dec. 19, 2013

Related U.S. Application Data

(63) Continuation-in-part of application No. PCT/CN2012/000324, filed on Mar. 15, 2012.

(30) Foreign Application Priority Data

Mar. 18, 2011 (CN) ..... 2011 1 0065649

(51) Int. Cl.
*A62B 1/20* (2006.01)
*A63G 21/00* (2006.01)

(52) U.S. Cl.
CPC ..... *A62B 1/20* (2013.01); *A63G 21/00* (2013.01)

(58) Field of Classification Search
CPC ..... A63G 21/00; A63G 21/04; A62B 1/20; A62B 5/00; A62B 1/00; E04F 11/04; E04F 11/06
USPC ..... 182/48, 49; 193/12
See application file for complete search history.

(56) References Cited

U.S. PATENT DOCUMENTS

| | | | | |
|---|---|---|---|---|
| 3,894,614 | A * | 7/1975 | Naka | 182/78 |
| 4,498,557 | A * | 2/1985 | Horne | 182/49 |
| 4,773,505 | A * | 9/1988 | Chiba | 182/49 |
| 5,535,848 | A * | 7/1996 | Giuliano et al. | 182/49 |
| 6,763,911 | B2 * | 7/2004 | Burch | 182/49 |
| 8,893,439 | B2 * | 11/2014 | Fujiwara et al. | 52/1 |
| 2013/0150171 | A1 * | 6/2013 | Khanna | 472/116 |

* cited by examiner

*Primary Examiner* — Daniel Cahn
(74) *Attorney, Agent, or Firm* — Matthias Scholl, PC; Matthias Scholl

(57) ABSTRACT

An escape chute, including: an upper straight chute, a lower straight chute, a turning chute, a first rotating axle, and a second rotating axle. The turning chute includes a front section, a middle section, and a rear section. The upper straight chute and the lower straight chute are connected via the turning chute. Each chute includes: a chute base; a guard rail including a top and a bottom; and a handrail. The chute base of the upper straight chute and the chute base of the lower straight chute are connected through the chute bases of the front, the middle, and the rear sections of the turning chute. Each hinge joint between the chute bases of the corresponding chutes is provided with a hinge roller. Each butt joint is provided with a combined pulley.

3 Claims, 23 Drawing Sheets

ESCAPE CHUTE

CROSS-REFERENCE TO RELATED APPLICATIONS

This application is a continuation-in-part of International Patent Application No. PCT/CN2012/000324 with an international filing date of Mar. 15, 2012, designating the United States, now pending, and further claims priority benefits to Chinese Patent Application No. 201110065649.8 filed Mar. 18, 2011. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 14781 Memorial Drive, Suite 1319, Houston, Tex. 77079.

BACKGROUND OF THE INVENTION

Field of the Invention

The invention relates to a safeguard device applied in buildings, and more particularly to an escape chute.

Description of the Related Art

Methods for high-rise evacuation in case of disaster includes: elevators, stairs, and outdoor space. Elevators are not a practical choice since it may be powered off in case of disaster. The difficult in evacuation from stairs is that the stairway is filled with fume and water, and is crowded with evacuating people. The evacuation from the outer space is much difficult and risky, and evacuating people often discard this method because of fear. Thus, high-rise evacuation is recognized as a world's problem.

In fact, in the high-rise evacuation in case of disaster, stairway evacuation is the first choice for most people. However, people easily faint after inhaling much fume, and easily slip down because of the water on the stairway. Besides, people are crowded in the stairway, which easily results in causalities. These problems are desired to be solved.

SUMMARY OF THE INVENTION

In view of the above-described problems, it is one objective of the invention to provide an escape chute that is convenient for use, safe and fast for people to evacuate, and is reasonably designed to save occupied space as much as possible when it is not used.

To achieve the above objective, in accordance with one embodiment of the invention, there is provided a straight escape chute, comprising: a handrail, a chute, a first rotating axle, and a second rotating axle. The chute comprises: a chute base and a guard rail comprising a top and a bottom. The handrail is fixed on the top of the guard rail. The bottom of the guard rail is in hinge joint with the chute base via the first rotating axle. An inner end of the chute base is connected to the second rotating axle, and the second rotating axle is further connected to a fixed plate arranged on a middle wall along with a direction of the stairway.

A sprinkler pipe is disposed on the middle wall.

The chute is a fixed chute or a folding chute. The folding chute comprises a curved connecting piece and a spring pin arranged on an end of each chute. The chute base is in hinge joint with the guard rail via the first rotating axle. A slide in the form of a strip groove is arranged on an end of the guard rail. An upper end of the slide comprises a positioning recess having a depth deeper than a depth of the slide. One end of the curved connecting piece is in hinged joint with the chute base, and the other end of the curved connecting piece is connected to the slide or the positioning recess arranged on the guard rail via the spring pin.

The straight chute further comprises coupling members comprising a pull rod, a push rod, an upper spring hoop, a lower spring hoop, and a wire rope. The upper spring hoop and the lower spring hoop are disposed on positions of the middle wall corresponding to a rear end of the upper straight chute and an upper end of the lower straight chute, respectively. The lower spring hoop is provided with the pull rod and the push rod. The wire rope comprises: one end connected to the pull rod via a ring, and the other end connected to the handrail of the rear end of the upper straight chute.

In accordance with another embodiment of the invention, there is provided a continuous escape chute formed by arranging a turning chute between an upper straight chute and a lower straight chute. The turning chute connects the upper straight chute and lower straight chute, thereby forming a continuous escape chute from a top floor to a ground floor.

The design of the turning chute complies with the structure of the building, that is, the curvature, the gradient, and the slope are reasonably combined to allow evacuating personals to decelerate to a speed of approximately zero but still in a moving state, thereby preventing personals from being deviated from the chute due to the acceleration in the straight chute.

The turning chute comprises three sections in shapes of sectors, that is, a front section, a middle section, and a rear section. Each section of the turning chute is connected to a third rotating axle arranged on the middle wall. The continuous escape chute further comprises: a first chute-linked wire rope, and a second chute-linked wire rope. The first chute-linked wire rope comprises: one end fixed on the guard rail of the upper straight chute, and the other end fixed on the guard rail of the middle section of the turning chute. The second chute-linked wire rope comprises: one end fixed on the guard rail of the lower straight chute, and the other end fixed on the guard rail of the middle section of the turning chute. A length of each of the chute-linked wire ropes is adjusted for meeting the requirement that when one chute is turned downward for 45°, adjacent chutes will be dragged through the chute-linked wire ropes.

An outer side of one chute is connected to another chute via a fourth rotating axle, thereby forming an escape chute comprising double chutes.

Two longitudinal ends of the chute base are provided with combined pulleys for intensifying the action of the downward sliding.

A middle position of an inner end of the chute base of the front section is connected to the middle wall via a first longitudinally positioning wire rope. A length of the first longitudinally positioning wire is controlled to allow the front section of the turning chute to connect with the middle section of the turning chute when the chute is pulled downwardly on the stairway.

A laterally positioning wire rope is provided. One end of the laterally positioning wire rope is fixed on the outer side of the guard rail of the upper straight chute at a lower edge of the corresponding handrail. A circular hole is disposed on an outer side of the guard rail of the front section (close to the middle section) of the turning chute at a lower edge of the corresponding handrail. The other end of the laterally positioning wire rope passes through the circular hole and is fixed on the outer side of the guard rail of the middle section of the turning chute at a lower edge of the corresponding handrail (close tithe front section). A length of the laterally positioning wire rope is controlled to allow two ends of the front section of the turning chute to seat inside the upper straight chute and the middle section of the turning chute, respectively.

The linkage comprising the middle section and the rear section of the turning chute and the lower straight chute is realized by a second longitudinally positioning wire and another laterally positioning wire rope using the same principle and method.

A bottom of the chute base of the middle section is provided with a supporting plate. The supporting plate is in a shape of a curved strip and has a length being one half of a width of the chute base. The supporting plate is in hinge joint with the chute base, and is capable of supporting the front section and the rear section of the turning chute when the escape chute is turned downwardly.

The edges of the guard rail of the middle section are provided with spiral column bases. A height of the spiral column bases is adjusted to place the turning chute on the staircase according to the slope of the turning chute.

The turning chute is connected to the middle wall through the third rotating axle.

When the escape chute is pulled upwardly to contact the middle wall, handrails of the front section and the upper straight chute overlap with each other. To save the overlapping space of the handrails, a connecting part between the front section of the turning chute and the middle wall is cut for accommodating the handrail of the front section, so that a turning mouth is formed therein.

As the chutes are linked, when the upper straight chute is turned downwardly, the turning chute is dragged through the chute-linked wire rope, so that the front section, the middle section, and the rear section of the turning chute are dragged downwardly, and are positioned by a combination of the first longitudinally positioning wire rope, the second longitudinally positioning wire rope, the chute-linked wire rope, the laterally positioning wire rope, and the sliding hole. The front section and the rear section are supported by the supporting plates of the middle section, thereby forming a connected turning chute. Two edges of both the front section and the rear section are provided with combined pulleys that are conducive to the downward sliding thereof and the formation of the turning chute.

Each section of the turning chute is connected with one another using corresponding chute bases thereof as connecting pieces. A guard plate is arranged on a middle wall of a stairyway. Each chute base of the upper straight chute and the lower straight chute is in hinge joint with the guard plate the middle wall through a second rotating axle.

The front, middle, and rear sections of the turning chute are connected together through chute bases, and thereof. The chute base of the upper straight chute and the chute base of the lower straight chute are connected through the chute bases, and of the front, the middle, and the rear sections, and of the turning chute.

The chute base of the turning chute comprises: the chute base of the front section in a shape of a sector, the rear base of the rear section in a shape of a sector, and the chute base of the middle section in a shape of a rectangular. The chute base of the front section is formed by hinging two chute bases of the same shape together.

The chute base of the front section comprises: a front end being in hinge joint with a rear end of the chute base of the upper straight chute, and a rear end being in hinge joint with a front end of the chute base of the middle section. The chute base of the middle section comprises: an inner end being in hinge joint with the guard plate of the middle wall via the second rotating axle, and a rear end being in hinge joint with a front end of the chute base of the rear section. A rear end of the chute base of the rear section is in butt joint with a front end of the chute base of the lower straight chute.

Each hinge joint between the chute bases of corresponding chutes is provided with a hinge roller. Each butt joint is provided with a combined pulley.

The escape chute is also provided with a chute-linked wire rope, a laterally positioning wire rope, a sliding hole, a detachable device, and a positioning hole to realize the linkage of the chutes and to tie the guard rails at a right angle to the corresponding chute bases.

To rotate the turning chute upwardly toward the middle wall, two chute bases of the front section are folded through the hinge roller. The front section is rotated to a left side of the middle wall and uprightly inserted into a space between the middle wall and the chute base of the upper straight chute. After that, the upper straight chute is fixed on the middle wall by the upper spring hoop A. The middle section of the turning chute is rotated uprightly to contact an end face of the middle wall. Meanwhile, the chute base of the rear section and the chute base of the middle section are folded through the hinge roller. The rear section is rotated to a right side of the middle wall and uprightly inserted into a space between the middle wall and the chute base of the lower straight chute. After that, the lower straight chute is fixed on the middle wall by the lower spring hoop.

In case of fire, the upper straight chute is rotated downward; the chute base of the upper straight chute and the chute base of the front section of the turning chute are unfolded and turned downwardly. Because the chute base of the front section is in high joint with the chute base of the middle section, and the chute base of the middle section is in hinge joint with the chute base of the rear section, the chute base of the middle section and the chute base of the rear section are turned downwardly one after another. Meanwhile, the lower straight chute is turned downwardly drawn by the chute-linked wire rope, and the chute base of the rear section is allow to connect to the lower straight chute, thereby forming a continuous escape chute.

In a class of this embodiment, the chute base of the front section of the turning chute comprises a front part in a rectangular shape and a rear part in a sector shape. A front end of the chute base of the front section is in lap joint with a rear end of the chute base of the upper straight chute and is disposed on a supporting plate arranged on the rear end of the chute base of the upper straight chute. A rear end of the chute base of the front section is in lap joint with an upper end of the chute base of the middle section and is disposed on a supporting plate of the chute base of the middle section. The chute base of the middle section comprises: an inner end being in hinge joint with the middle wall via the second rotating axle, and a rear end being in hinge joint with a front end of the chute base of the rear section. A rear end of the chute base of the rear section is in butt joint with a front end of the chute base of the lower straight chute.

Each hinge joint between the chute bases of corresponding chutes is provided with a hinge roller. Each butt joint and lap joint is provided with a combined pulley.

When the upper straight chute is rotated downwardly, the chute base of the front section of the turning chute slides downwardly along with the supporting plate of the chute base of the upper straight chute and the supporting plate of the chute base of the middle section. The chute base of the front section is then located at the guard rail of the middle section. Thus, the supporting plate of the upper straight chute and the supporting plate of the middle section, thereby forming the lap joint with the upper straight chute and the middle section, respectively.

The guard rail of the front section comprises: a front part divided into two members of the same shapes and in hinge joint with the rectangular-shaped front chute base; and a rear part in hinge joint with the sector-shaped rear chute base. The upper end of the guard rail of the front section is connected with the guard rail of the upper straight chute, and the lower end of the guard rail of the front section is connected to guard rails of the middle section, the rear section, and the guard rail of the lower straight chute one after another.

Structures and embodiments of the guard rails are the same those of first technical scheme, that is, the linkage of the guard rails and functions thereof are realized by using the sliding hole, the detachable device, the positioning hole, and the laterally positioning wire rope.

In a class of this embodiment, the turning chute is provided with a lifting device comprising a lifting slide, a balance iron slide, a pulley, a hanging wire rope, and a balance iron. The hanging wire rope comprises: one end fixed on the balance iron, and the other end is fixed on the turning chute through the pulley. The turning chute comprises a supporting plate on a bottom, and the supporting plate is able to support the turning chute and drive the turning chute to move upwardly and downwardly inside the lifting slide. The balance iron is disposed inside the balance iron slide and is downwardly and upwardly movable in an opposite direction of the movement of the turning chute.

The straight chute are provided with two structures, that is, the chute base and the guard rail are in the form of a hinge joint, or in the form of integrally fixation. The turning chute of the continuous escape chute is also provided with two structures, that is, the integrally fixation or the hinge joint. Different structures of the straight chute and the turning chute are combined according to practical conditions of the building.

In a class of this embodiment, the escape chute further comprises a fire-proof ventilation device comprising a baffle, a ventilation pipe, a fume vent, and a fume extraction fan. The baffle separates an upper stairway from a lower stairway from a middle position for allowing the fume to rise regularly. The fume vent and the fume extraction fan are disposed on an outer wall of a top of each floor for allowing the fume of an inner side of the wall to communicate with the ventilation pipe arranged on an outer side of the wall. The ventilation pipe is disposed on an outer side of the wall from the top floor to the ground floor. When two ends of the ventilation pipe are open, a strong gas current is produced inside the ventilation pipe and a negative pressure is formed, so that the fume is able to be extracted out from the stairway to the outdoor space through the ventilation pipe while the fume extraction fan is started to work. Once the fume is extracted out, the danger of the fire is largely lowered and is beneficial to the evacuation of the people.

Advantages of the invention are summarized as follows:

1. The escape chute of the invention is convenient for use. In case of disaster, people turned the chute of one floor downwardly, combined with the mechanical linkage, a domino effect is triggered so as to allow chutes of other floors are uniformly turned downwardly and form a continuous escape chute. People seat inside the chute to slide down to the ground floor.

2. People can place one hand on the handrail to control the slide speed, thereby being convenient and safe.

3. As the chutes lay on the staircase, which is a bottom relative to the up flowing poisoning gas and fume, so that evacuating people are prevented from being poisoned by the fume.

4. When the chute is turned downwardly, sprinkler pipes are open for spraying water to the chute, evacuating people seat in the chute can get wet, thereby being prevented from burning as well as prevented from inhaling the fume by using the wet cloth to cover the nose and mouth. Thus, the water sprinkler provides people with protection from the fire and the fume as they slide downward along the chute.

5. The escape chute of the invention allows people to evacuate in order, so that the frequency of causalities is largely decreased.

6. The guard rail is provided with the upright rod, and the arm rest is arranged on the upright rod and is positioned by the cross rod. When the chutes are turned downwardly and connected as a whole, the arm rest are also connected, which is helpful for firemen to go upstairs to extinguish the fire. Thus, the evacuating people and the firemen are separated on their own ways.

7. The application of the escape chute in the high-stair buildings is able to largely lower the danger and the cost for the firemen to save people, so that it is conducive to help the firemen to extinguish the fire.

8. When the escape chute is not used, it can be turned upwardly and fixed on the middle wall, thereby saving the space. The spring hoop can be provided with an electromagnetic iron device, a switch of the electromagnetic iron device is protected by a glass cover. In case of fire, the glass cover is crushed to turn off the switch, or the electromagnetic iron device is powered off because of fire, to allow the escape chute to be released from the spring hoop and descend on the staircase to form the continuous escape chute.

If the staircase has a width of exceeding two meters, the staircase can be provided with the special escape chute or the escape chute comprising double chutes to improve the evacuation efficiency in case of disaster. The escape chute of the invention is beneficial for people in high-stair buildings to evacuate in case of disasters. The escape chute of the invention employs a mechanical linkage, which is a preferable means.

The escape chute of the invention has a reasonable structure and low cost. It is convenient and safe in use, and is suitable for the high-stair buildings. For a building having thirty floors, the escape chute of the invention allows each person to take three seconds to slide over each floor and two minutes to the ground floor. If three persons slide down from each floor, the escape chute allows hundreds of people to evacuate simultaneously. It is preferable to use the escape chute combined with techniques of the fire-proof ventilation device.

Different combinations of the straight chute, the turning chute, and the linkage mechanism can be employed in accordance with the practical conditions of stairways of the high-stair buildings.

BRIEF DESCRIPTION OF THE DRAWINGS

The invention is described herein below with reference to the accompanying drawings, in which.

Figure 1:
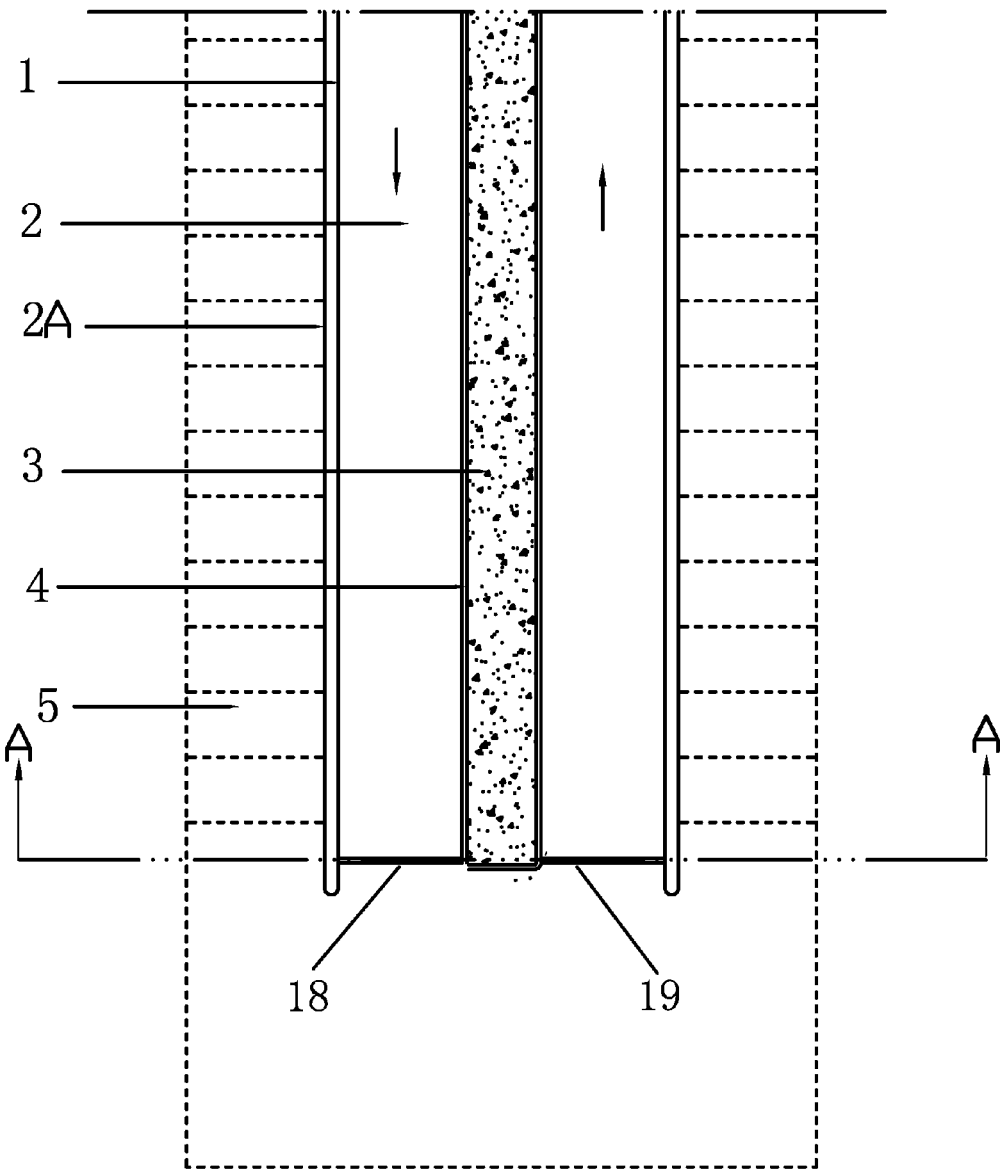
FIG. 1 is a top view of two straight escape chutes in accordance with one embodiment of the invention.

In the drawings, the following reference numbers are used: 1. Hand rail; 2. Chute base; 2A. Guard rail; 2B. Supporting plate of middle section of turning chute; 2C. Column base of turning chute; 3. Middle wall; 3A. Guard plate; 4. Sprinkler pipe; 5. Stairway; 6. Combined pulley; 7. Turning chute; 7A. Supporting plate of bottom of turning chute; 8. Second rotating axle; 8A. First rotating axle; 8B. Hinge roller; 9. Positioning recess; 10. Spring pin; 10A. Slide; 11. Curved connecting piece; 13. Wire rope; 15. A first rod end; 16. A second rod end; 17. Lower spring hoop; 17A. Upper spring hoop; 18. Rear end of upper straight chute; 19. Front end of lower straight chute; 20A. Chute base of front section of turning chute; 21. Middle section of turning chute; 21A. Chute base of middle section of turning chute; 21B. Supporting plate of chute base of middle section of turning chute; 22. Rear section of turning chute; 23. Turning mouth; 24. Third rotating axle; 25. First longitudinally positioning wire rope; 26. Second longitudinally positioning wire rope; 27. Chute-linked wire rope; 27A. Laterally positioning wire rope; 27B. Sliding hole; 27C. Detachable device; 27D. Positioning hole; 28. Upright rod; 29. Cross rod; 30. Arm rest; 32. Lifting slide; 33. Balance iron slide; 34. Pulley; 35. Hanging wire rope; 36. Balance iron; 37. Upper stairway; 38. Lower stairway; 39. Baffle; 40. Outer wall of building; 41. Ventilation pipe; 42. Fume extraction fan; and 43. Fume.

DETAILED DESCRIPTION OF THE EMBODIMENTS

For further illustrating the invention, experiments detailing an escape chute are described below. It should be noted that the following examples are intended to describe and not to limit the invention.

Example 1

Figure 2:
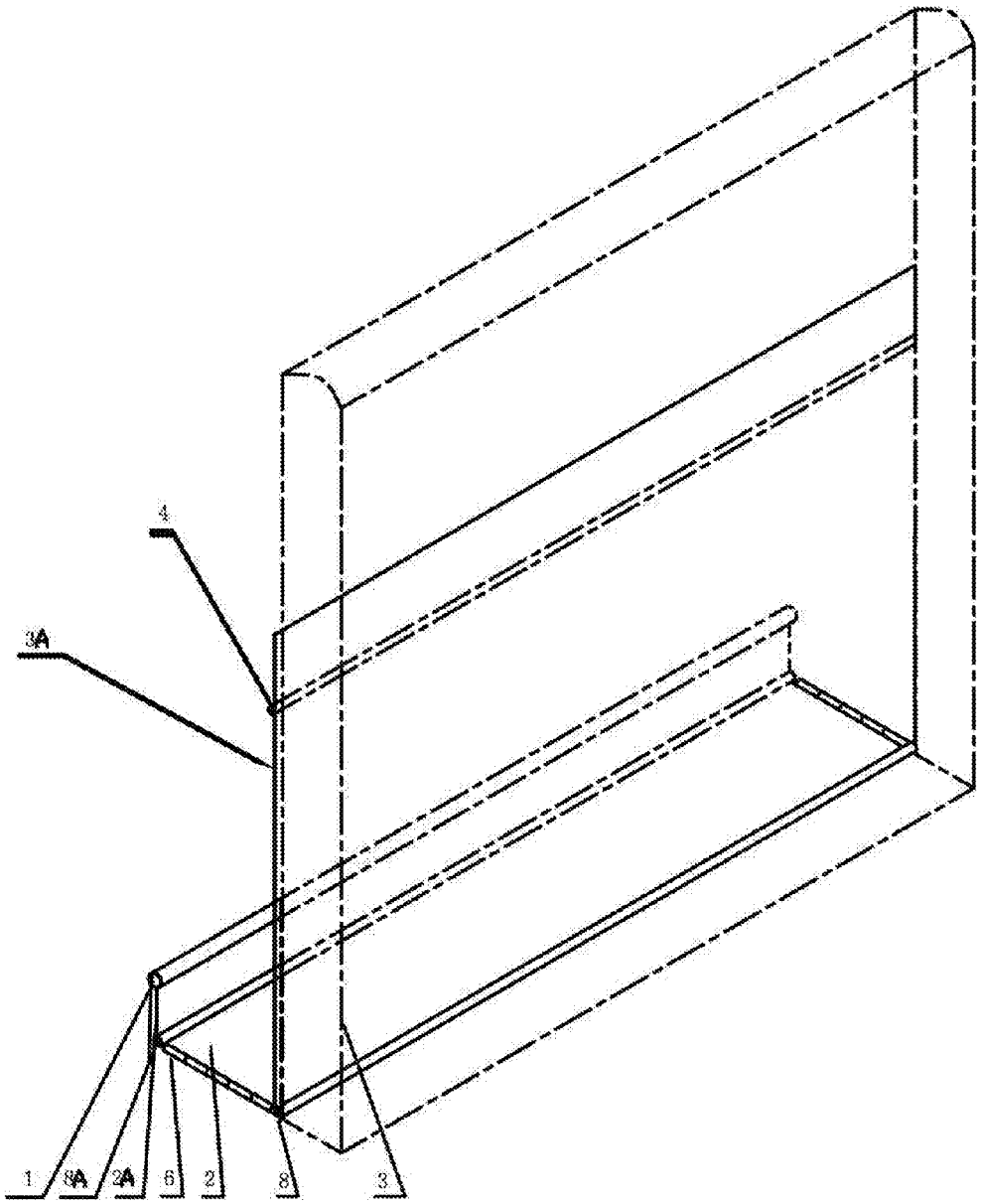
FIG. 2 is a stereogram of a straight escape chute in accordance with one embodiment of the invention.
Figure 3:
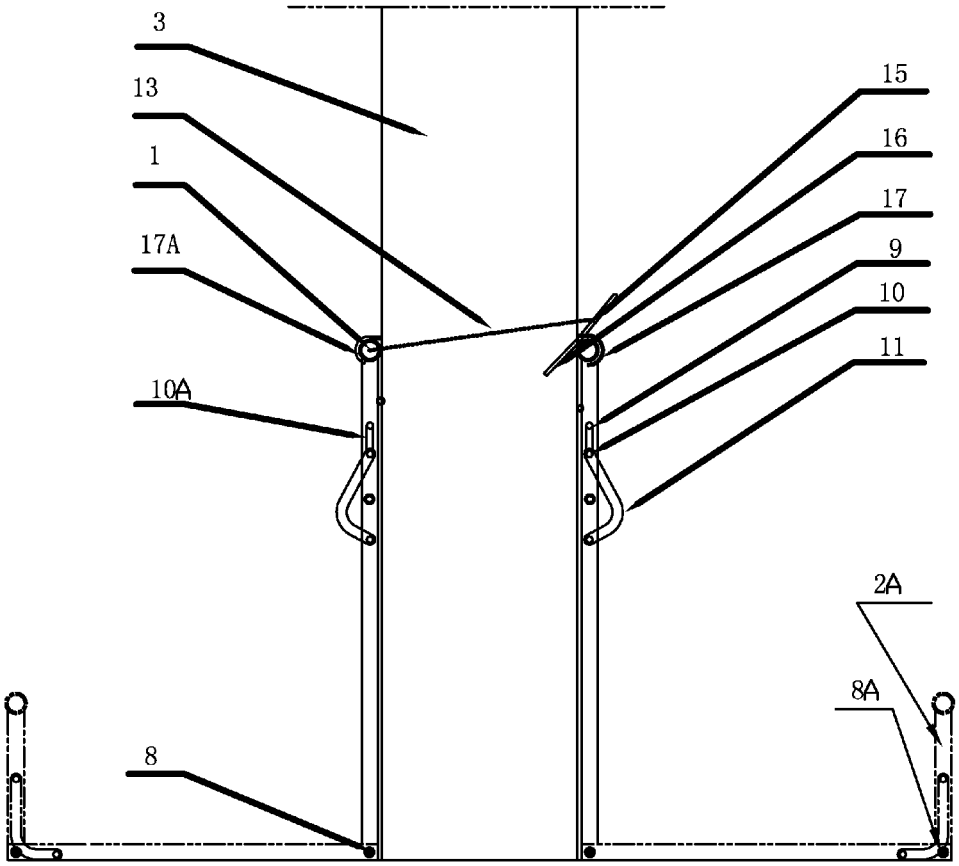
FIG. 3 is a cross-sectional view of the two straight escape chutes taken along line A-A in FIG. 1, and it shows the two straight escape chutes when they are not deployed and fixed on a middle wall and when they are deployed and disposed on two adjacent stairways in accordance with one embodiment of the invention.

As shown in FIGS. 1-4 are structure diagram of a straight escape chute and coupling devices thereof. The straight escape chute employs straight chutes that are arranged on a middle wall 3 of a secure channel. The straight chute comprises: a handrail 1, a chute, a first rotating axle 8A, and a second rotating axle 8. The chute comprises: a chute base 2, and a guard rail 2A comprising a top and a bottom. The handrail 1 is fixed on the top of the guard rail 2A. The bottom of the guard rail 2A is in hinge joint with the chute base 2 via the first rotating axle 8A. An inner end (the end close to the middle wall 3) of the chute base 2 is connected to the second rotating axle 8, and the second rotating axle 8 is further connected to a fixed plate 3A arranged on the middle wall (3) along with a direction of the stairway. When the straight escape chute is not used, the chute base 2 and the guard rail 2A are turned upwardly toward the wall through the first rotating axle 8A and the second rotating axle 8, and the handrail 1 is clamped by a spring hoop 17A arranged on the middle wall 3 (as shown in FIG. 3) so as to fix the chute on the middle wall 3.

As shown in FIGS. 2-3, a sprinkler pipe 4 is disposed on the middle wall 3.

Figure 4:
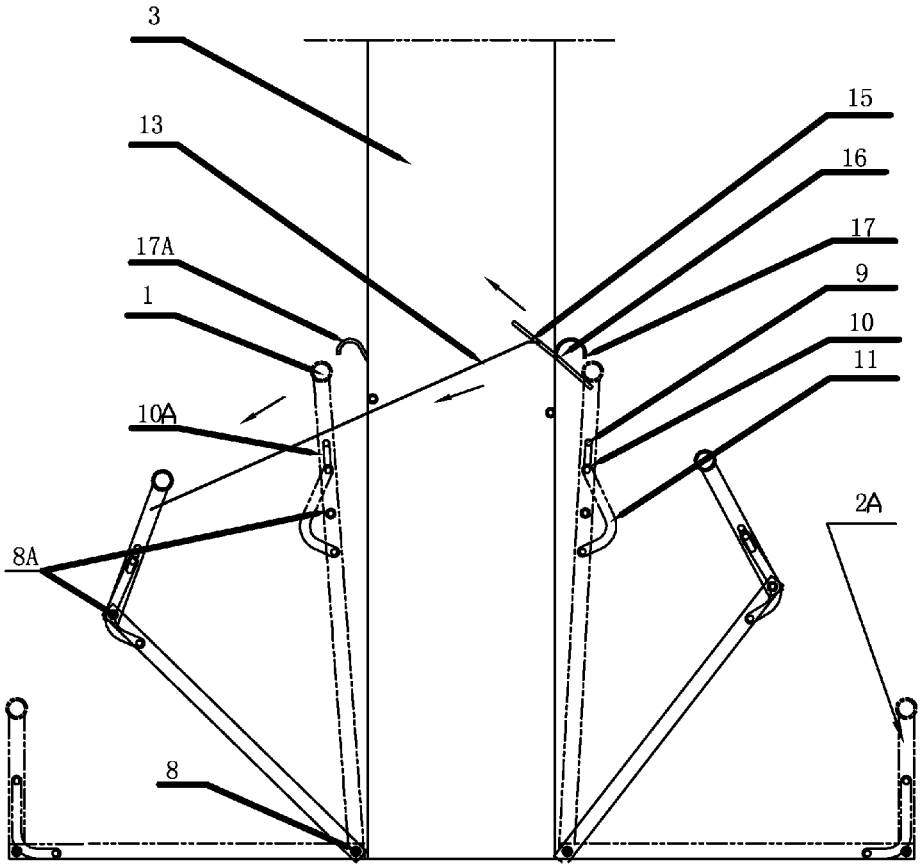
FIG. 4 is a cross-sectional view of the two straight escape chutes taken along line A-A in FIG. 1, and it shows the two straight escape chutes in different positions when they are turned downwardly from the middle wall to the stairways in accordance with one embodiment of the invention.

As shown in FIGS. 3-4, the chute comprises a curved connecting piece 11 and a spring pin 10 arranged on an end of each chute. A slide 10A in the form of a strip groove is arranged on an end of the guard rail 2A. An upper end of the slide comprises a positioning recess 9 having a depth deeper than a depth of the slide 10A. One end of the curved connecting piece 11 is in hinged joint with the chute base 2, and the other end of the curved connecting piece 11 is connected to the slide 10A (when the chute is fixed on the middle wall 3) or the positioning recess 9 (when the chute is turned downwardly to the stairway) arranged on the guard rail 2A via the spring pin 10. One end of the spring pin 10 is connected to the curved connecting piece 11, and the other end of the spring pin 10 is disposed inside the slide 10A. The spring pin 10 is movable in the slide 10A under the action of a spring, and when the spring pin 10 is moved to the upper end of the slide 10A, the spring pin 10 is inserted into the positioning recess 9.

As shown in FIGS. 3-4, the straight chute further comprises: a rod having a first rod end 15 and a second rod end 16, an upper spring hoop 17A, a lower spring hoop 17, and a wire rope 13. The upper spring hoop 17A and the lower spring hoop 17 are disposed on positions of the middle wall corresponding to a rear end of the upper straight chute and an upper end of the lower straight chute, respectively. The lower spring hoop 17 is provided with the first rod end 15 and the second rod end 16. When the chute is turned upwardly toward the middle wall 3, one end of the wire rope 13 is connected to the first rod end 15 via a ring, and the other end of the wire rope 13 is connected to the handrail 1 of the rear end of the upper straight chute.

To turn the chute upwardly towards the middle wall and allow the chute to lean against the middle wall, pull the spring pin 10 out of the positioning recess 9 arranged on the guard rail 2A, turn the chute base 2 and the guard rail 2A upwardly to contact with the middle wall 3, clamp the handrail 1 using the upper spring hoop 17A or the upper spring hoop 17, so that the chute is fixed on the middle wall 3.

In case of fire, as shown in FIG. 4, persons pull the handrail 1 of the upper straight chute out of the upper spring hoop 17A so as to turn the upper straight chute downwardly towards the stairway. Meanwhile, the wire rope 13 drives the first rod end 15 via the ring to allow the lower spring hoop 17 to open, and under the action of the second rod end 16, the handrail of the lower straight chute is separated from the lower spring hoop 17, so that the chute base 2 and the guard rail 2A are turned downwardly towards the corresponding stairway. The spring pin 10 moves upwardly inside the slide 10A arranged on the guard rail 2A; when the guard rail 2A and the chute base 2 form a right angle, the spring pin 10 moves into the positioning recess 9 so as to fix the relative positions between the guard rail 2A and the chute base 2. Thus, the chute is turned downwardly on the stairway via the second rotating axle 8, and the sprinkler pipe 4 is opened for spraying water.

Figure 5:
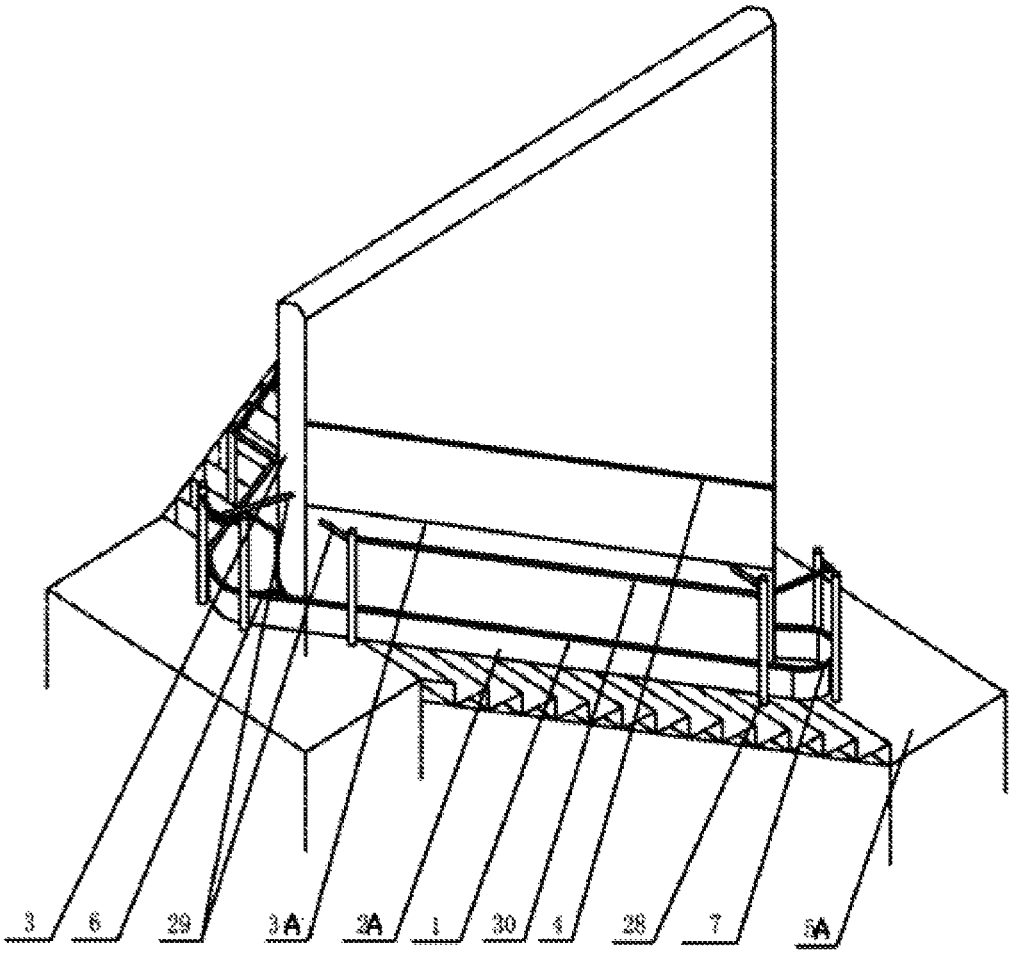
FIG. 5 is an assembled diagram of a continuous escape chute in accordance with one embodiment of the invention.
Figure 6:
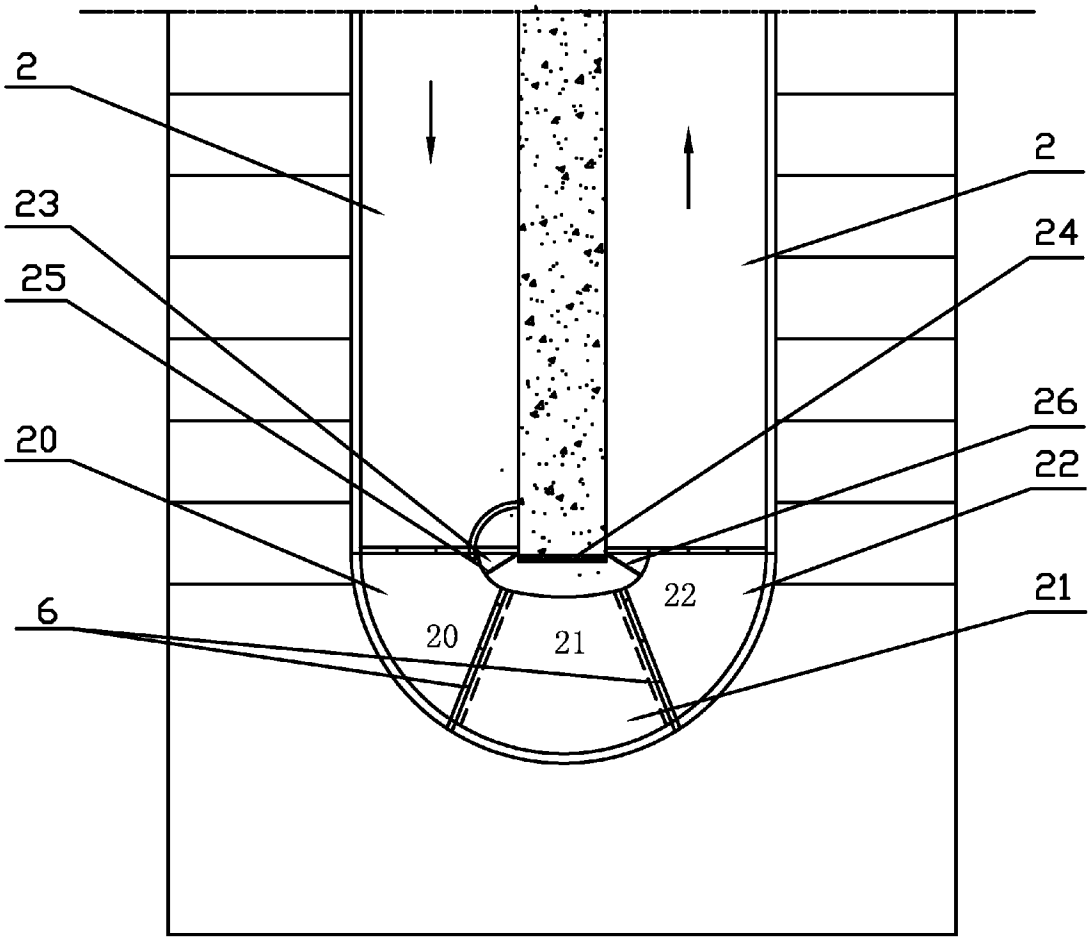
FIG. 6 is a top view of a turning chute of a continuous escape chute in accordance with one embodiment of the invention.
Figure 7:
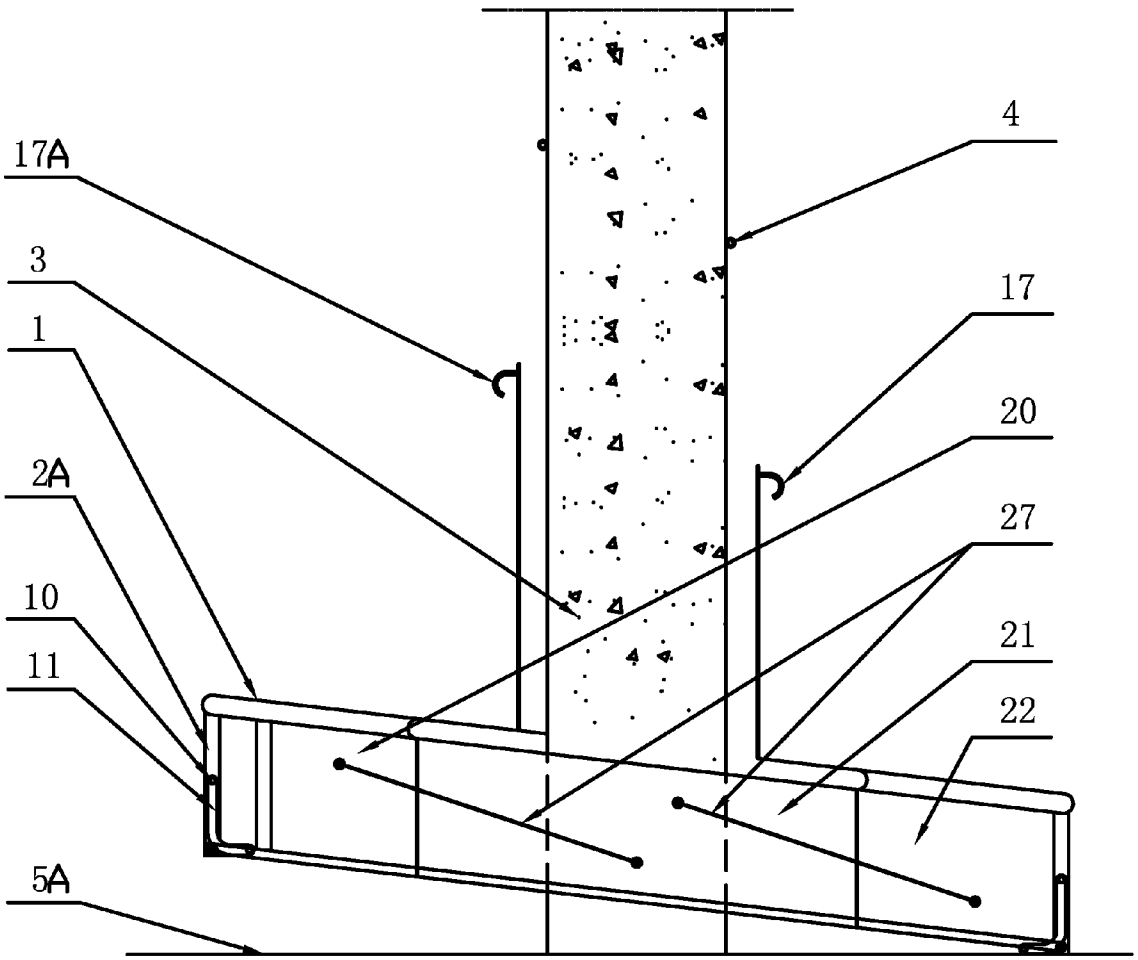
FIG. 7 is a front view of a turning chute of a continuous escape chute in accordance with one embodiment of the invention.
Figure 10A:
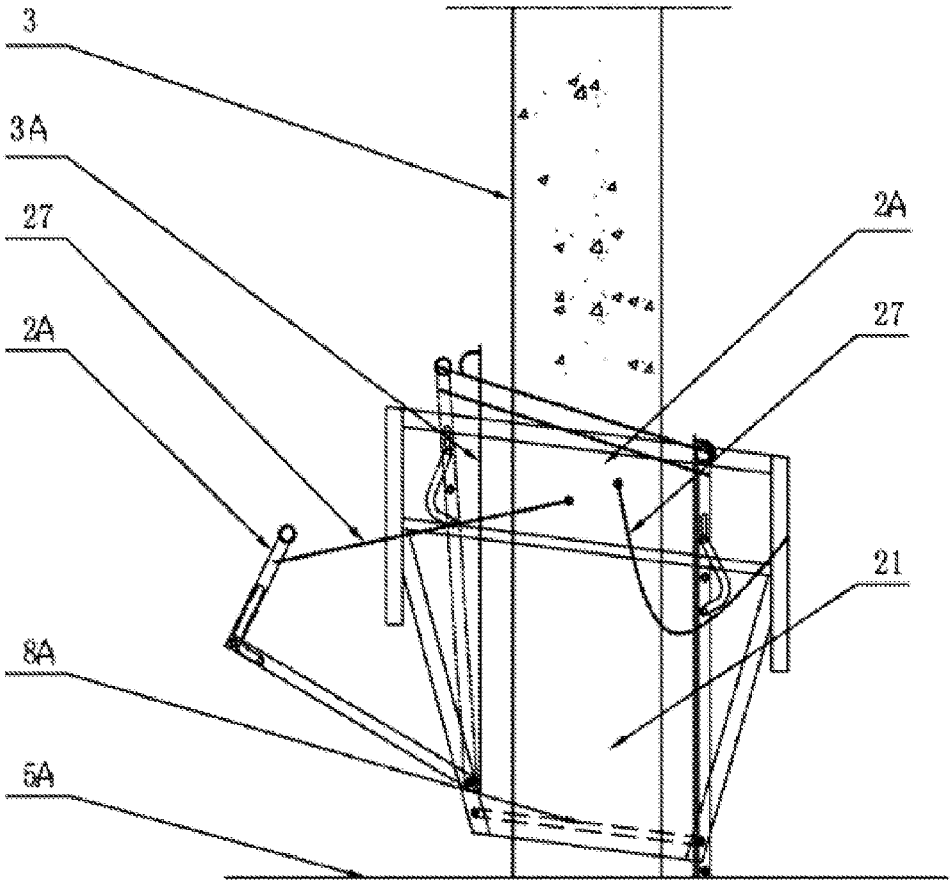
FIG. 10A is a front view of a linkage between an upper straight chute and a turning chute of a continuous escape chute in accordance with one embodiment of the invention.
Figure 10B:
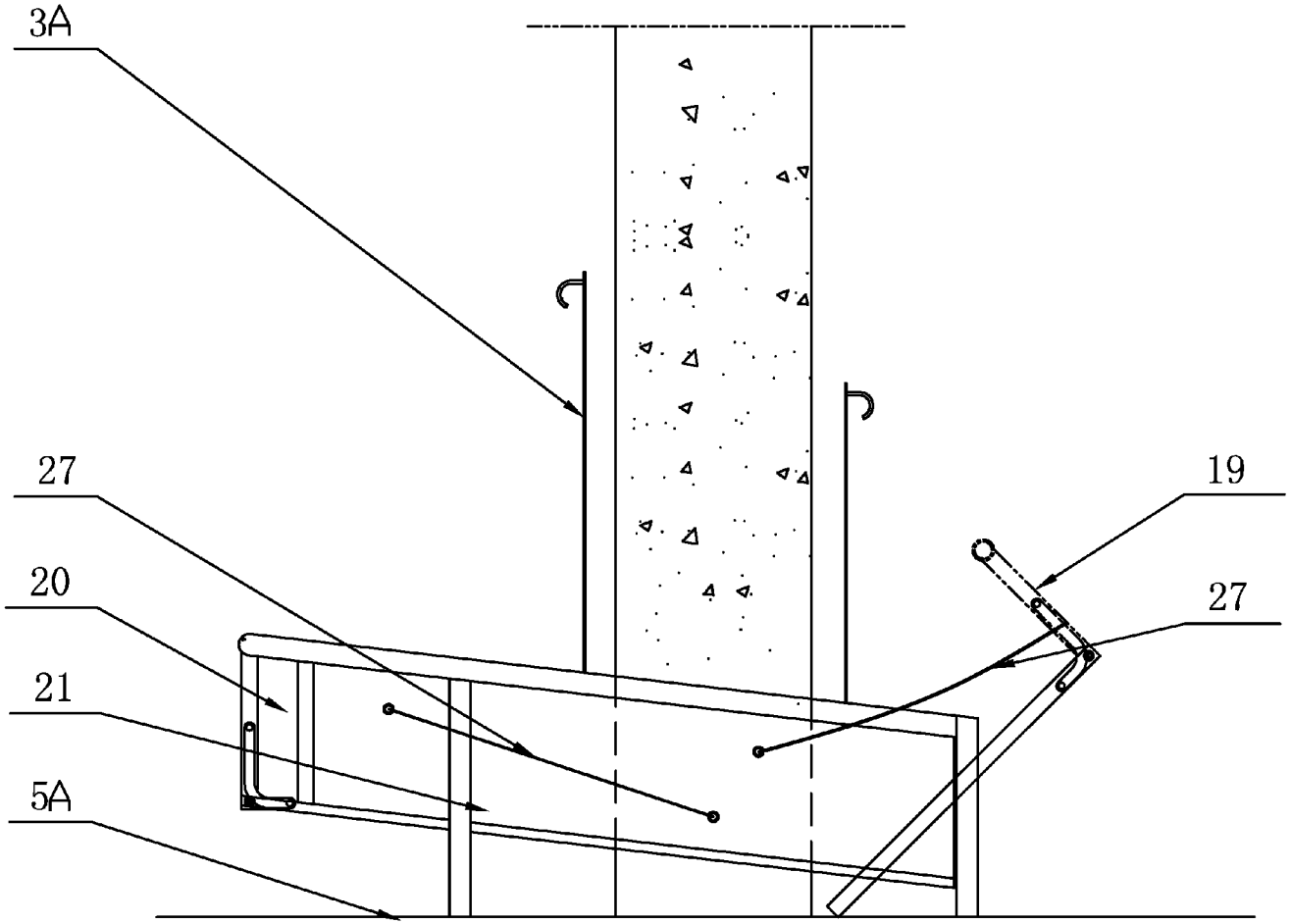
FIG. 10B is a front view of a linkage between a turning chute and a lower straight chute of a continuous escape chute in accordance with one embodiment of the invention.

A continuous escape chute and coupling devices thereof is as shown in FIG. 5. The continuous escape chute is formed by arranging a turning chute 7 between an upper straight chute and a lower straight chute. The turning chute 7 connects the upper straight chute and lower straight chute, thereby forming a continuous escape chute from a top floor to a ground floor. The turning chute 7 comprises three sections in shapes of sectors, as shown in FIG. 6, that is, a front section 20, a middle section 21, and a rear section 22. The sections of the turning chute 7 overlaps with one another and are connected to a third rotating axle 24 arranged on the middle wall 3. The improvement of the structure is adding the turning chute provided with coupling members on the basis of the straight chutes so as to connect adjacent upper and lower straight chute to form a continuous escape chute from the top floor to the ground floor As shown in FIG. 7, the continuous escape chute further comprises: a first chute-linked wire rope 27, and a second chute-linked wire rope 27. The first chute-linked wire rope 27 comprises: one end fixed on an outer side of the guard rail 2A of the upper straight chute at a distance of two thirds of a height of the guard rail 2A from the first rotating axle 8A, and the other end fixed on an outer side of the guard rail 2A of the middle section 21 of the turning chute 7 at a distance of one third of a height of the guard rail 2A from the first rotating axle 8A. The second chute-linked wire rope 27 comprises: one end fixed on an outer side of the guard rail 2A of the lower straight chute at a distance of two thirds of a height of the guard rail 2A from the first rotating axle 8A, and the other end fixed on the outer side of the guard rail 2A of the middle section 21 of the turning chute 7 at a distance of one third of a height of the guard rail 2A from the first rotating axle 8A. A length of each of the chute-linked wire ropes 27 is adjusted for meeting the requirement that when one chute is turned downward for 45°, as shown in FIGS. 10A-10B, adjacent chutes will be dragged through the chute-linked wire ropes 27.

A middle position of an inner end of the chute base 2 of the front section 20 is connected to the middle wall 3 via a first longitudinally positioning wire rope 25. A length of the first longitudinally positioning wire 25 is controlled to allow the front section 20 of the turning chute to connect with the middle section 21 of the turning chute when the chute is pulled downwardly on the stairway.

A laterally positioning wire rope 27A is provided. One end of the laterally positioning wire rope 27A is fixed on the outer side of the guard rail 2A of the upper straight chute at a lower edge of the corresponding handrail 1. A circular hole is disposed on an outer side of the guard rail 2A of the front section 20 (close to the middle section 21) of the turning chute at a lower edge of the corresponding handrail 1. The other end of the laterally positioning wire rope 27A passes through the circular hole and is fixed on the outer side of the guard rail 2A of the middle section 21 of the turning chute at a lower edge of the corresponding handrail 1 (close to the front section 20). A length of the laterally positioning wire rope 27A is controlled to allow two ends of the front section 20 of the turning chute to seat inside the upper straight chute and the middle section 21 of the turning chute, respectively.

The linkage comprising the middle section 21 and the rear section 22 of the turning chute and the lower straight chute is realized by a second longitudinally positioning wire 26 and another laterally positioning wire rope 27A using the same principle and method.

A bottom of the chute base 2 of the middle section is provided with a supporting plate 2B. The supporting plate 2B is in a shape of curved strip and has a length being one half of a width of the chute base 2. The supporting plate 2B is in hinge joint with the chute base 2, and is capable of supporting the front section 20 and the rear section 22 of the turning chute when the escape chute is turned downwardly.

The edges of the guard rail 2A of the middle section 21 are provided with spiral column bases 2C. A height of the spiral column bases 2C is adjusted to place the turning chute on the staircase according to the slope of the turning chute.

The turning chute 21 is connected to the middle wall 3 through the third rotating axle 24.

When the escape chute is pulled upwardly to contact the middle wall 3, handrails of the front section 20 and the upper straight chute overlaps with each other. To save the overlapping space of the handrails, a connecting part between the front section 20 of the turning chute and the middle wall 3 is cut for accommodating the handrail of the front section 20, so that a turning mouth 23 is formed therein.

Figure 8:
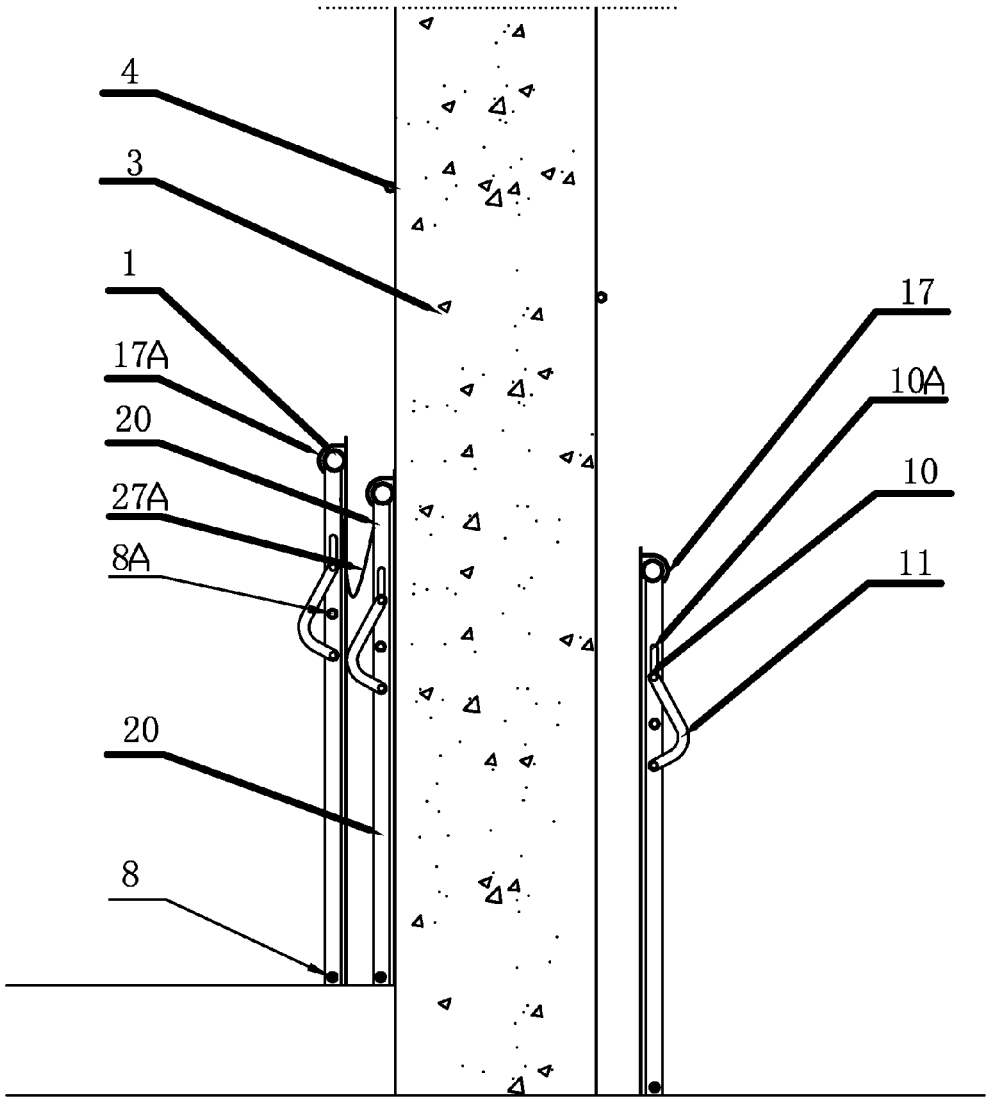
FIG. 8 is a front view of straight chutes of a continuous escape chute being turned upwardly and fixed on a middle wall in accordance with one embodiment of the invention.
Figure 9:
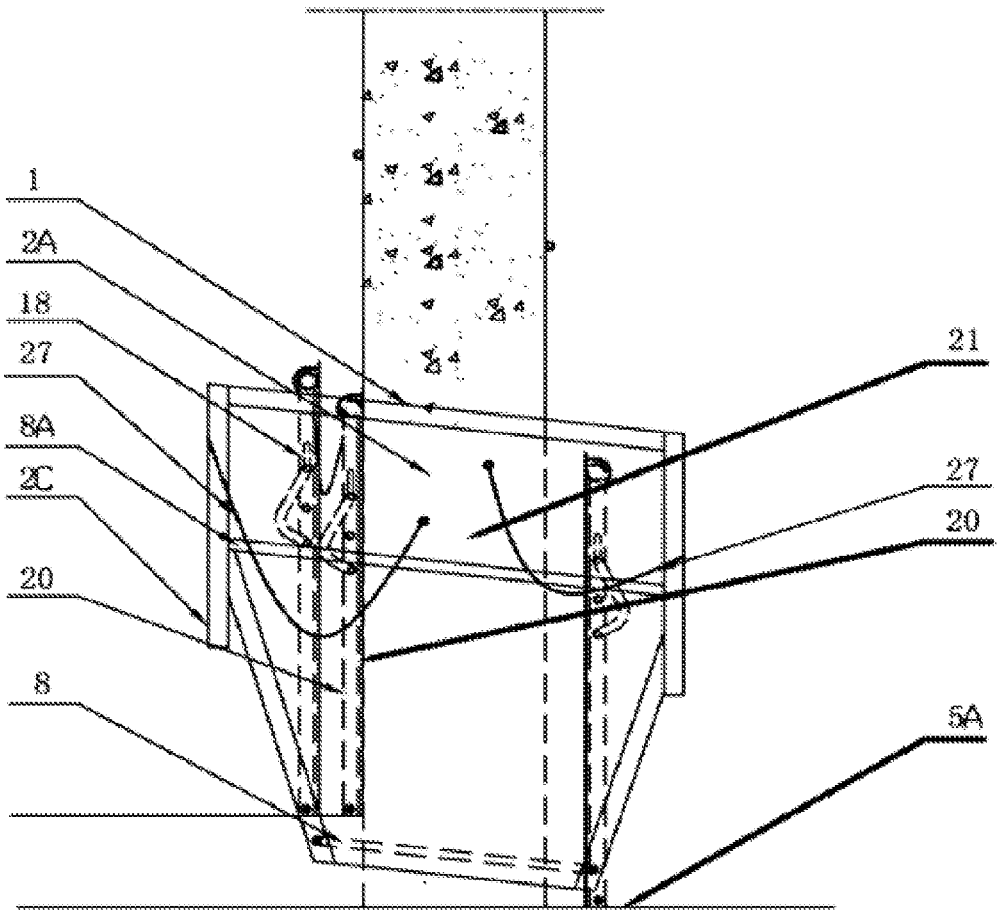
FIG. 9 is a front view of a turning chute of a continuous escape chute being turned upwardly and fixed on a middle wall in accordance with one embodiment of the invention.

As shown in FIGS. 6-7, the front section 20, the middle section 21, and the rear section 22 of the turning chute 7 are in the shapes of sectors. The turning chute is packed in the form of overlapping structure, that is, the front section 20 is disposed inside the upper straight chute, and the turning mouth 23 is a curved notch for allowing the front section 20 to disposed inside the upper straight chute during package (as shown in FIG. 8).

As shown in FIG. 10A, persons pull the handrail 1 of the upper straight chute out of the upper spring hoop 17A to turn the chute base 2 and the guard rail 2A of the upper straight chute downwardly and allow the first chute-linked wire rope 27 to drag the middle section 21 of the turning chute simultaneously. As the chute base 2 and the guard rail 2A of the upper straight chute are turned downwardly, the spring pin 10 moves upwardly along the slide 10A arranged on the guard rail 2A (as shown in FIGS. 3-4) until the spring pin 10 moves into the positioning recess 9. Thus, the guard rail 2A and the chute base 2 form a right angle and relative positions thereof are fixed, as shown in FIG. 10B.

As the middle section 21 of the turning chute is turned downwardly, the lower straight chute is dragged by the middle section 21 through the second chute-linked wire rope 27, thereby forming a domino effect.

As the upper straight chute is turned downwardly, the front section 20 of the turning chute is correspondingly driven downwardly. When the chute base and the guard rail of the front section form a right angle under the drive of the first longitudinally positioning wire rope 25, one end of the chute base 20A of the front section 20 is in lap joint with the chute base 2 of the upper straight chute, while the other end of the chute base 20A of the front section 20 is able to connect with the middle section 21. Meanwhile, the circular hole beneath the handrail 1 of the front section 20 slides along the laterally positioning wire rope 27A to allow the front section 20 to dispose inside the upper straight chute and the middle section 21. Two edges of the chute base 20A of the front section are provided with combined pulleys 6. The rear section 22 is disposed on the middle section 21. When the middle section 21 is turned downwardly, the rear section 22 is dragged downwardly by the second longitudinally positioning wire rope 26 and is connected to the lower straight chute. The circular hole beneath the handrail 1 of the rear section 22 slides along the laterally positioning wire rope 27A to allow the rear section 22 to dispose inside the middle section 21 and the lower straight chute. Two edges of the chute base 22A of the rear section 22 are provided with combined pulleys 6. The front section 20 and the rear section 22 are disposed on the supporting plate 2B of the middle section 21.

Meanwhile, the upright rod 28 is also turned downwardly and the upright rod 28 is positioned by the cross rod 29. The upright rod 28 is provided with an arm rest 30, thereby being convenient for people to evacuate, as shown in FIG. 5.

Simultaneously, sprinkler pipes 4 arranged on the middle wall are open for spraying water.

On the basis of the straight escape chute and the continuous escape chute, different combinations comprising the straight chute, the turning chute, and the coupling devices can be designed according to practical requirements of different buildings.

Figure 11:
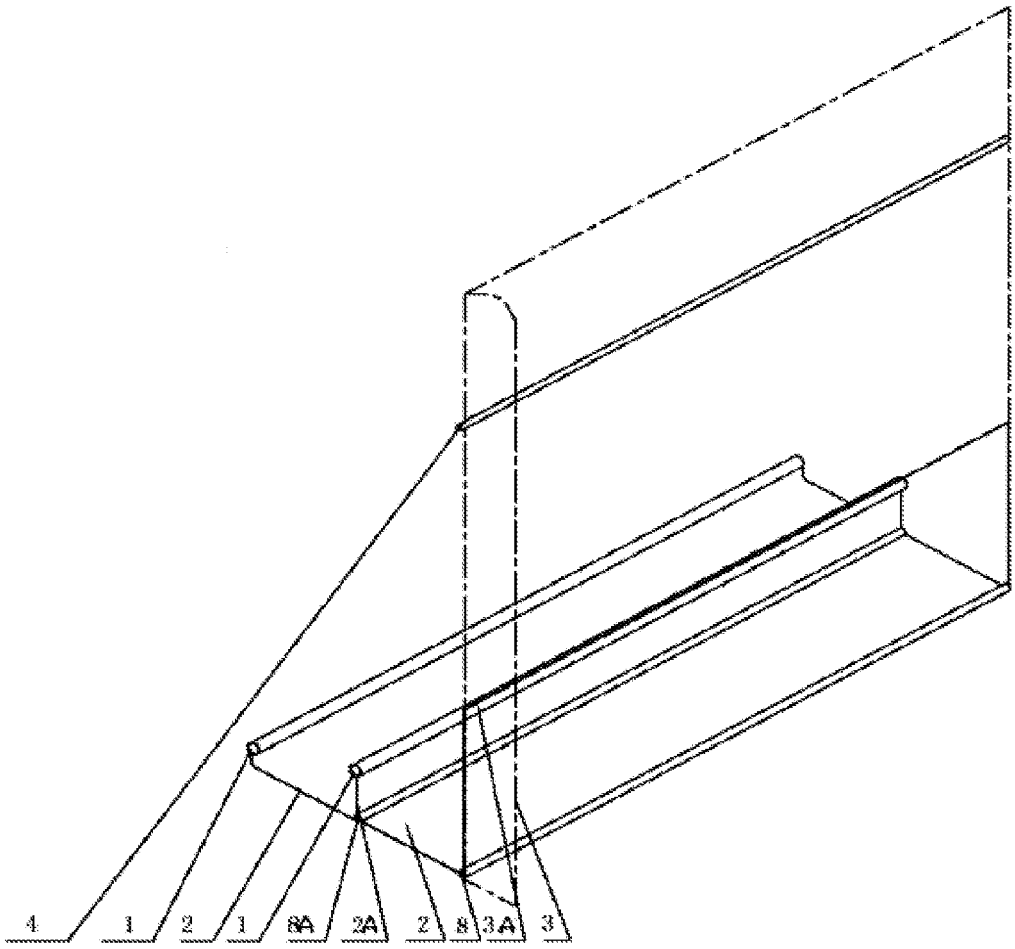
FIG. 11 is an escape chute comprising double chutes in accordance with one embodiment of the invention.

An outer side of the continuous escape chute or the straight escape chute is provided with another straight escape chute, thereby forming a chute comprising double chutes, as shown in FIG. 11. When the straight chute is provided with another straight chute, the chute base 2 of the outer straight chute is connected to a forth rotating axle 8A. A width of the chute base 2 of the outer straight is approximately the same as that of the inner straight chute. The handrail 1 is disposed on the outer edge of the chute base 2. In case of fire, the outer chute and the inner chute are turned downwardly simultaneously to the stairway to form the chute comprising double chutes, thereby realizing a fast evacuation of people.

Figure 12:
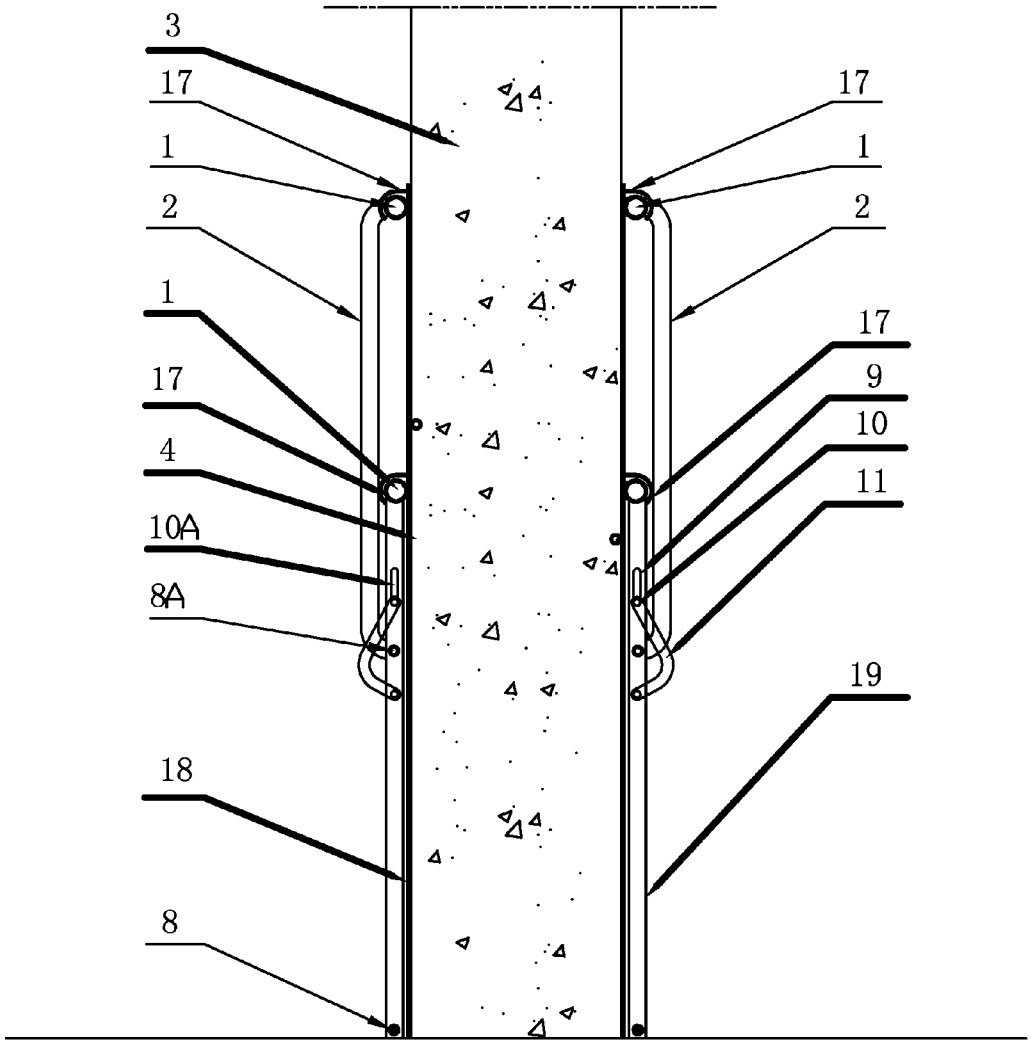
FIG. 12 is front view of an escape chute comprising double chutes being turned upwardly and fixed on a middle wall in accordance with one embodiment of the invention.

To turn the chute upwardly to be fixed on the middle wall 3, the handrail 1 of the outer straight chute is clamped by the spring hoop (as shown in FIG. 12).

Example 2

Figure 13:
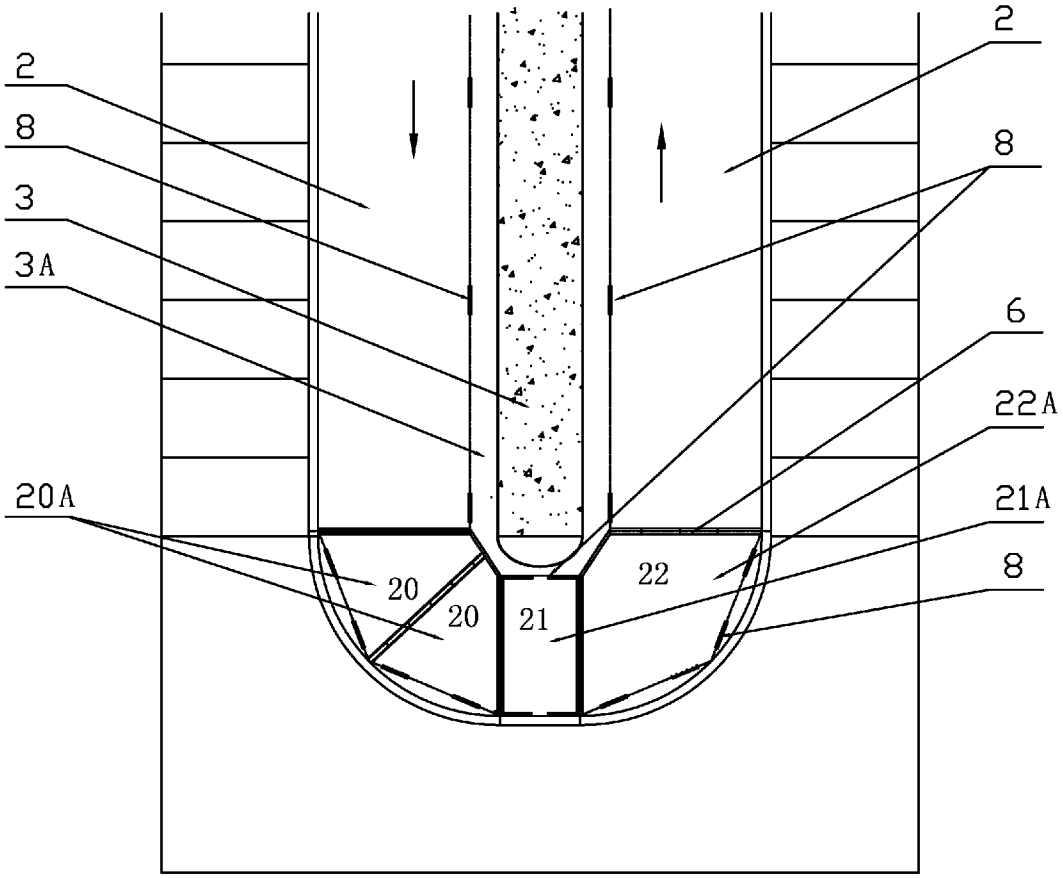
FIG. 13 is a top view of connected chute bases of a turning chute in accordance with one embodiment of the invention.
Figure 14:
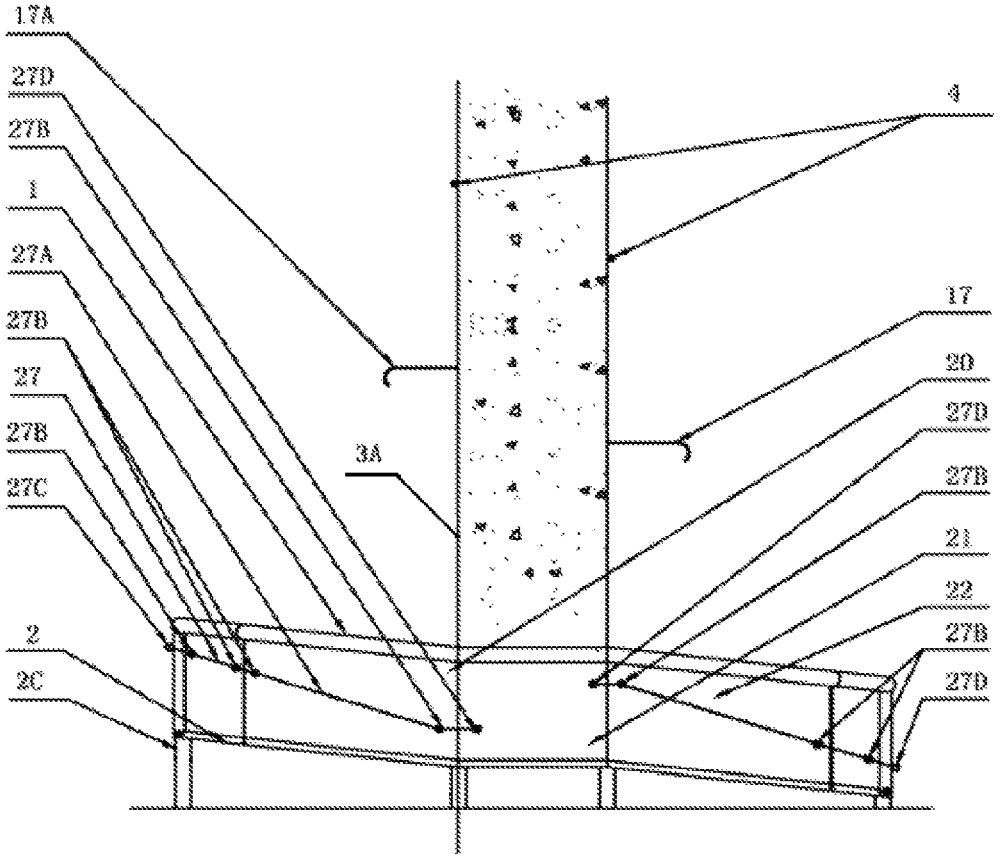
FIG. 14 is front view of connected guard rail of turning chute in accordance with one embodiment of the invention.

As shown in FIG. 13, an escape chute comprises: an upper straight chute, a lower straight chute, and a turning chute 7 comprising a front section 20, a middle section 21, and a rear section 22. A guard plate 3A is arranged on a middle wall 3 of a stairyway. The front, middle, and rear sections 20, 21, and 22 of the turning chute 7 are connected together through chute bases 20A, 21A, and 22A thereof. Each chute base 2 of the upper straight chute and the lower straight chute is in hinge joint with the guard plate 3A of the middle wall through a second rotating axle 8.

The chute base 2 of the upper straight chute and the chute base 2 of the lower straight chute are connected through the chute bases 20A, 21A, and 22A of the front, the middle, and the rear sections 20, 21, and 22 of the turning chute 7.

The chute base 2 of the turning chute 7 comprises: the chute base 20A of the front section 20 in a shape of a sector, the rear base 22A of the rear section 22 in a shape of a sector, and the chute base 21A of the middle section 21 in a shape of a rectangular. The chute base 20A of the front section 20 is formed by hinging two chute bases of the same shape together.

The chute base 20A of the front section 20 comprises: a front end being in hinge joint with a rear end of the chute base 2 of the upper straight chute, and a rear end being in hinge joint with a front end of the chute base 21A of the middle section 21. The chute base 21A of the middle section 21 comprises: an inner end being in hinge joint with the guard plate 3A of the middle wall via the second rotating axle 8, and a rear end being in hinge joint with a front end of the chute base 22A of the rear section 22. A rear end of the chute base 22A of the rear section 22 is in butt joint with a front end of the chute base 2 of the lower straight chute.

Each hinge joint between the chute bases of corresponding chutes is provided with a hinge roller 8B. Each butt joint is provided with a combined pulley 6.

Figure 16:
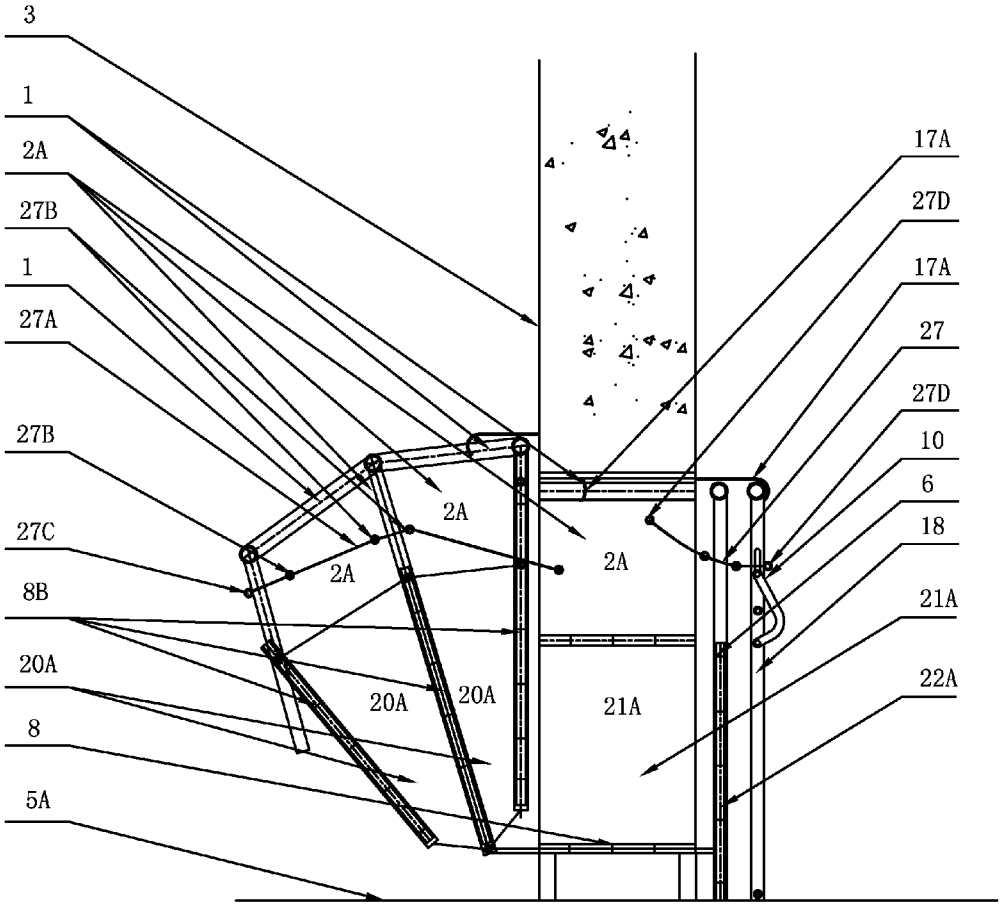
FIG. 16 is a front view of a linkage between an upper straight chute and a front section of a turning chute in accordance with one embodiment of the invention.
Figure 17:
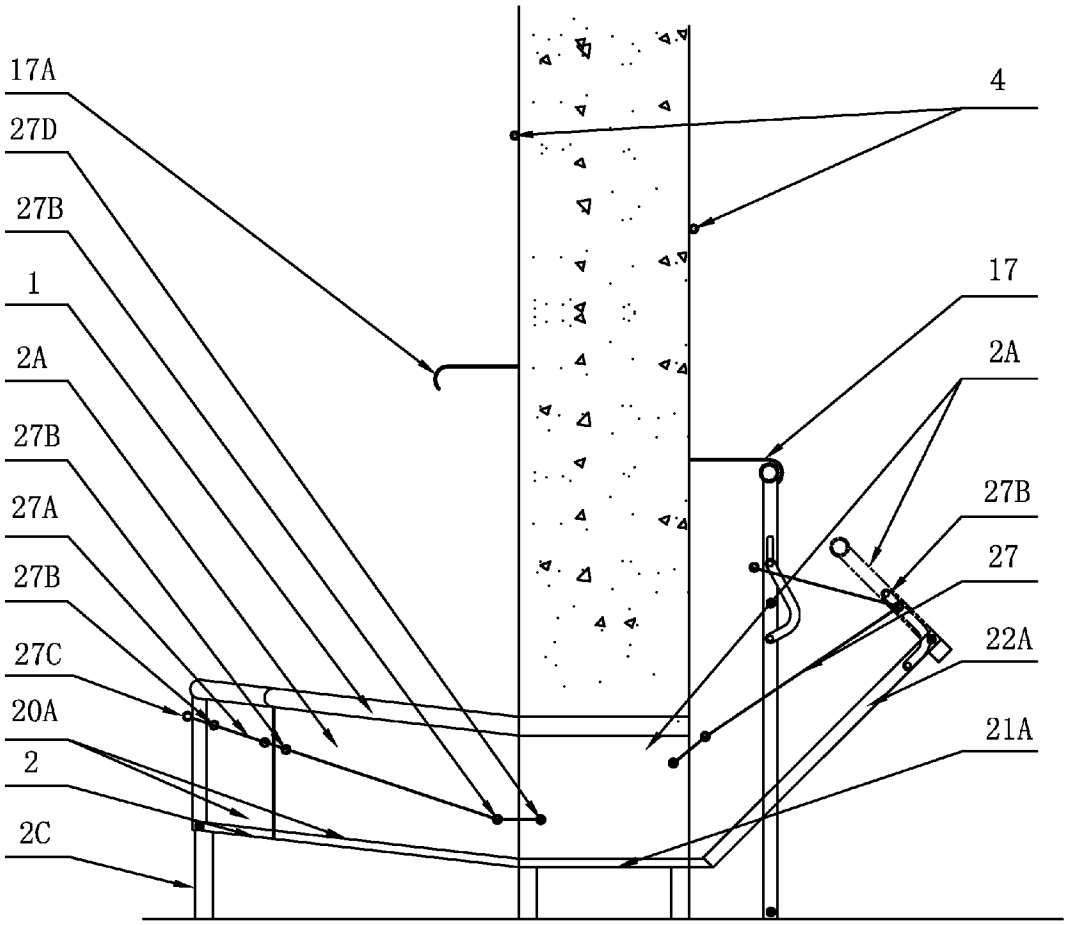
FIG. 17 is a front view of a linkage between a middle section of turning chute and a lower straight chute in accordance with one embodiment of the invention.

The escape chute comprises a chute-linked wire rope for the linkage of guard rails 2A. As shown in FIGS. 13, 16, and 17, the guard rail 2A of the front section 20 and the guard rail 2A of the rear section 22 are both composed of two parts of the same shapes, and each part is provided with a sliding hole 27B arranged beneath a handrail 1 for allow a laterally positioning wire rope 27A to pass through. A detachable device 27C is disposed on one end of the upper straight chute beneath the handrail 1 to connect the laterally positioning wire rope 27A, the connection thereof is detachable. A positioning hole 27D is arranged beneath the handrail 1 of the middle section 21 of the turning chute for fixing one end of the laterally positioning wire rope 27A. The other end of the laterally positioning wire rope 27A passes through the sliding holes 27B of the front section 20 and connects to the detachable device 27C of the upper straight chute, the connection of herein is detachable. One end of the chute-linked wire rope 27 is fixed on one end of the lower straight chute close to the rear section 22 beneath the handrail 1, the other end thereof passes through sliding holes 27B beneath the handrail of the rear section 22 and connects to the positioning hole 27D beneath the handrail 1 of the middle section 21.

To turn downwardly the upper straight chute, the laterally positioning wire rope 27A passes through the sliding holes 27B beneath the handrail 1 of front section 20, draws the middle section 21 of the turning chute downwardly, and allows the chute bases 20A, 21A to form right angles relative to the corresponding guard rails 2A. Meanwhile, the position of one end of the chute-linked wire rope 27 connected to the positioning hole 27D of the middle section 21 descends; because of the linkage of the sliding holes 27B on the rear section 22 beneath the handrail 1, the other end of the chute-liked wire rope 27 draws the lower straight chute downwardly and allows the guard rail 2A and the chute base 22A of the rear chute 22 to form a right angle. As the lower straight chute is turned downwardly, the spring pin 10 moves along the slide 10A until it is fixed in the positioning recess 9, thus, the chute-linked wire rope 27 is tightly fixed on the guard rails 2A.

Figure 15:
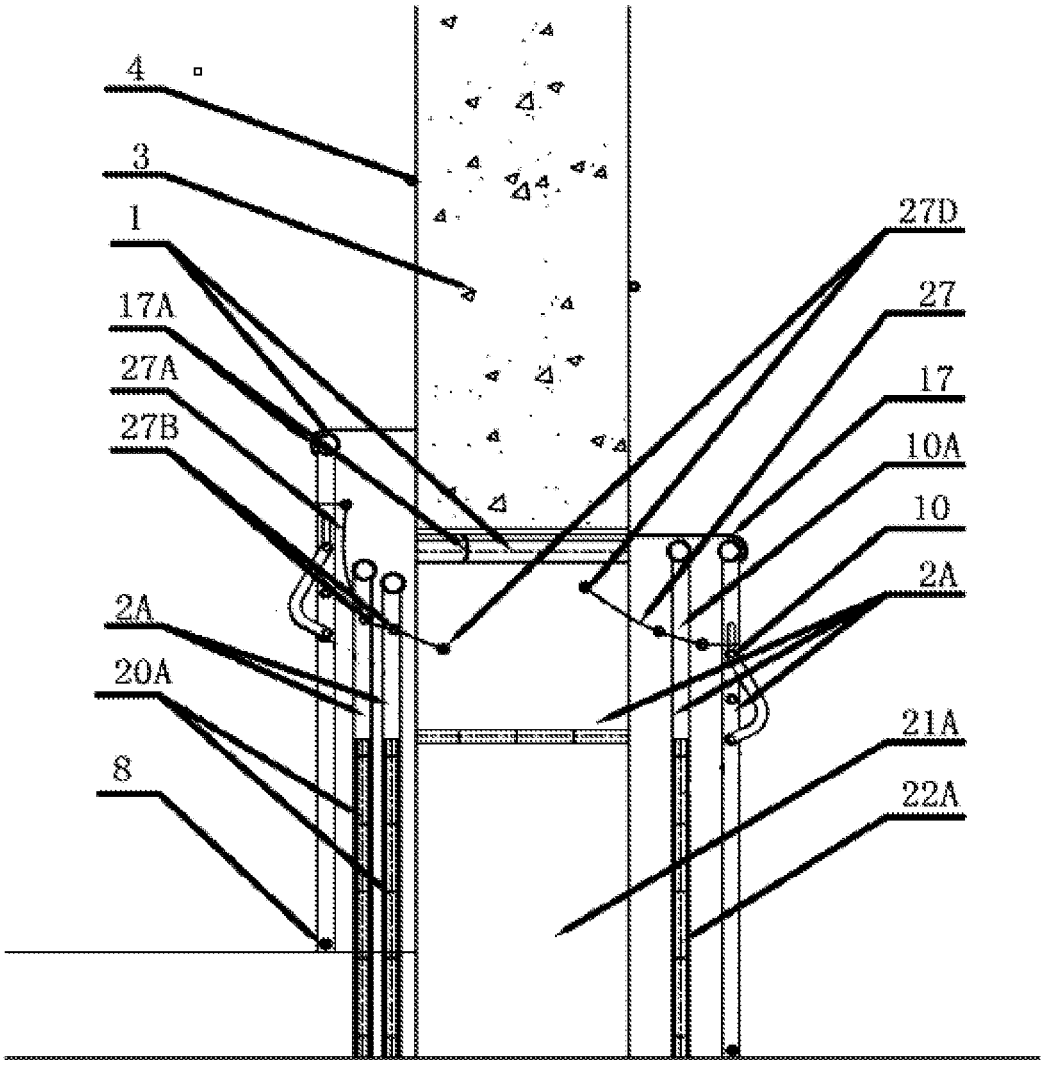
FIG. 15 is a front view of a continuous escape chute being turned upwardly and fixed on a middle wall in accordance with one embodiment of the invention.

As shown in FIG. 15, to rotate the turning chute 7 toward the middle wall, two chute bases 20A of the front section 20 are folded through the hinge roller 8B. The front section is rotated to a left side of the middle wall and uprightly inserted into a space between the middle wall 3 and the chute base 2 of the upper straight chute. After that, the upper straight chute is fixed on the middle wall by the upper spring hoop 17A. The middle section 21 of the turning chute is rotated uprightly to contact an end face of the middle wall. Meanwhile, the chute base 22A of the rear section 22 and the chute base 21A of the middle section 21 are folded through the hinge roller 8B. The rear section is rotated to a right side of the middle wall and uprightly inserted into a space between the middle wall 3 and the chute base 2 of the lower straight chute. After that, the lower straight chute is fixed on the middle wall by the lower spring hoop 17.

In case of fire, the upper straight chute is rotated downward, the chute base 2 of the upper straight chute and the chute base 20A of the front section 20 of the turning chute are unfolded and turned downwardly. Because the chute base 20A of the front section 20 is in high joint with the chute base 21A of the middle section 21, and the chute base 21A of the middle section 21 is in hinge joint with the chute base 22 of the rear section 21, the chute base 21A of the middle section 21 and the chute base 22A of the rear section 22 are turned downwardly one after another. Meanwhile, the lower straight chute is turned downwardly drawn by the chute-linked wire rope 27, and the chute base 22A of the rear section 22 is allow to connect to the lower straight chute, thereby forming a continuous escape chute.

Example 3

Figure 18A:
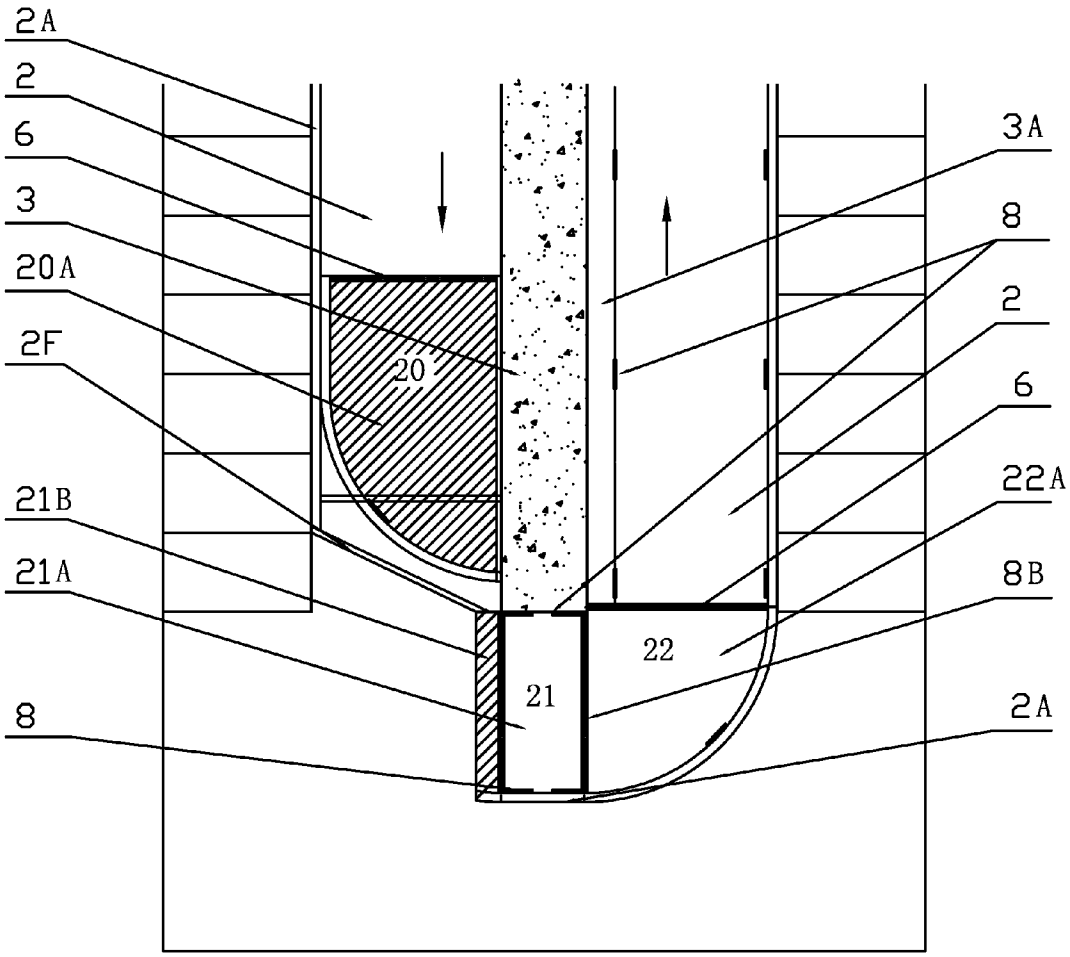
FIG. 18A is a top view of a chute base of the turning chute before a front section is positioned in accordance with one embodiment of the invention.
Figure 18B:
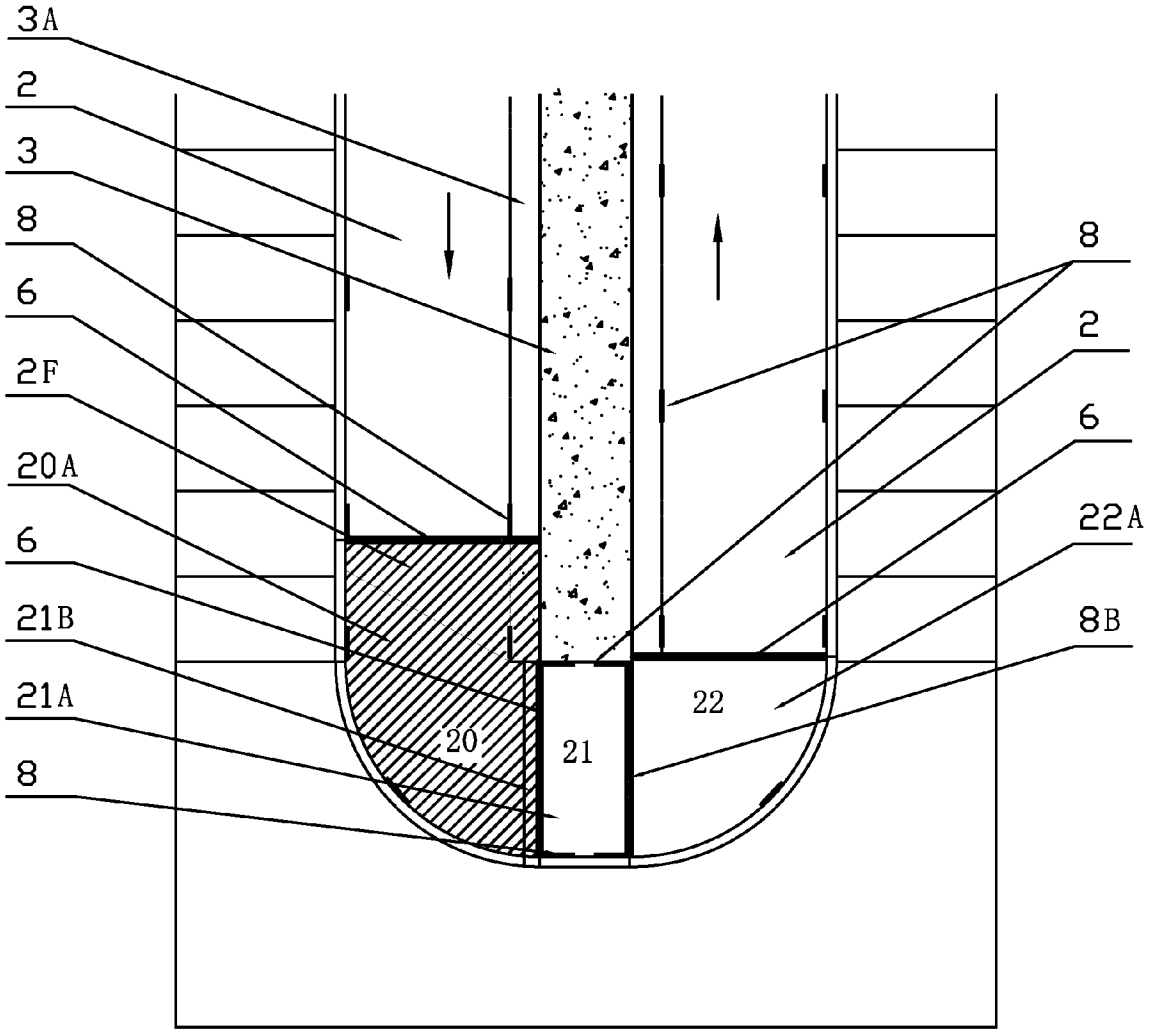
FIG. 18B is a top view of a chute base of the turning chute after a front section is positioned in accordance with one embodiment of the invention.
Figure 19:
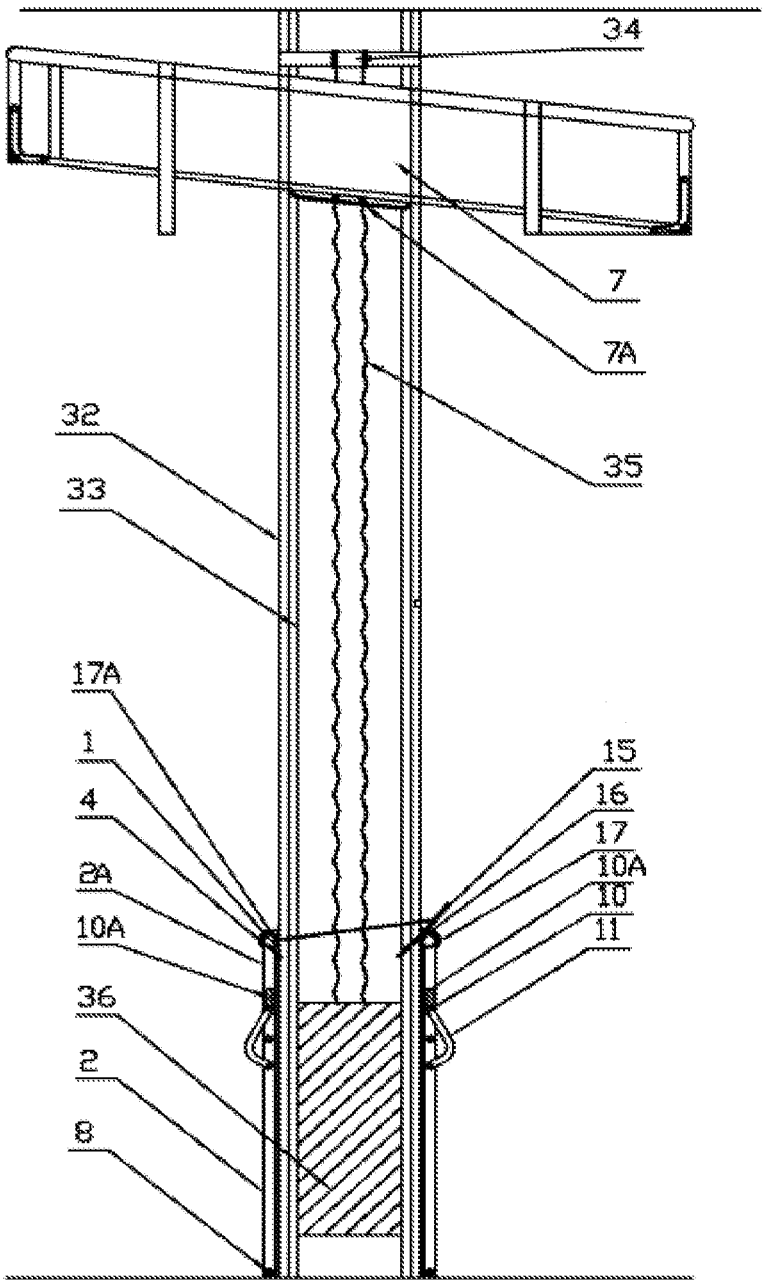
FIG. 19 is a front view of a turning chute lifted to a top of a floor by a lifting device in accordance with one embodiment of the invention.
Figure 20:
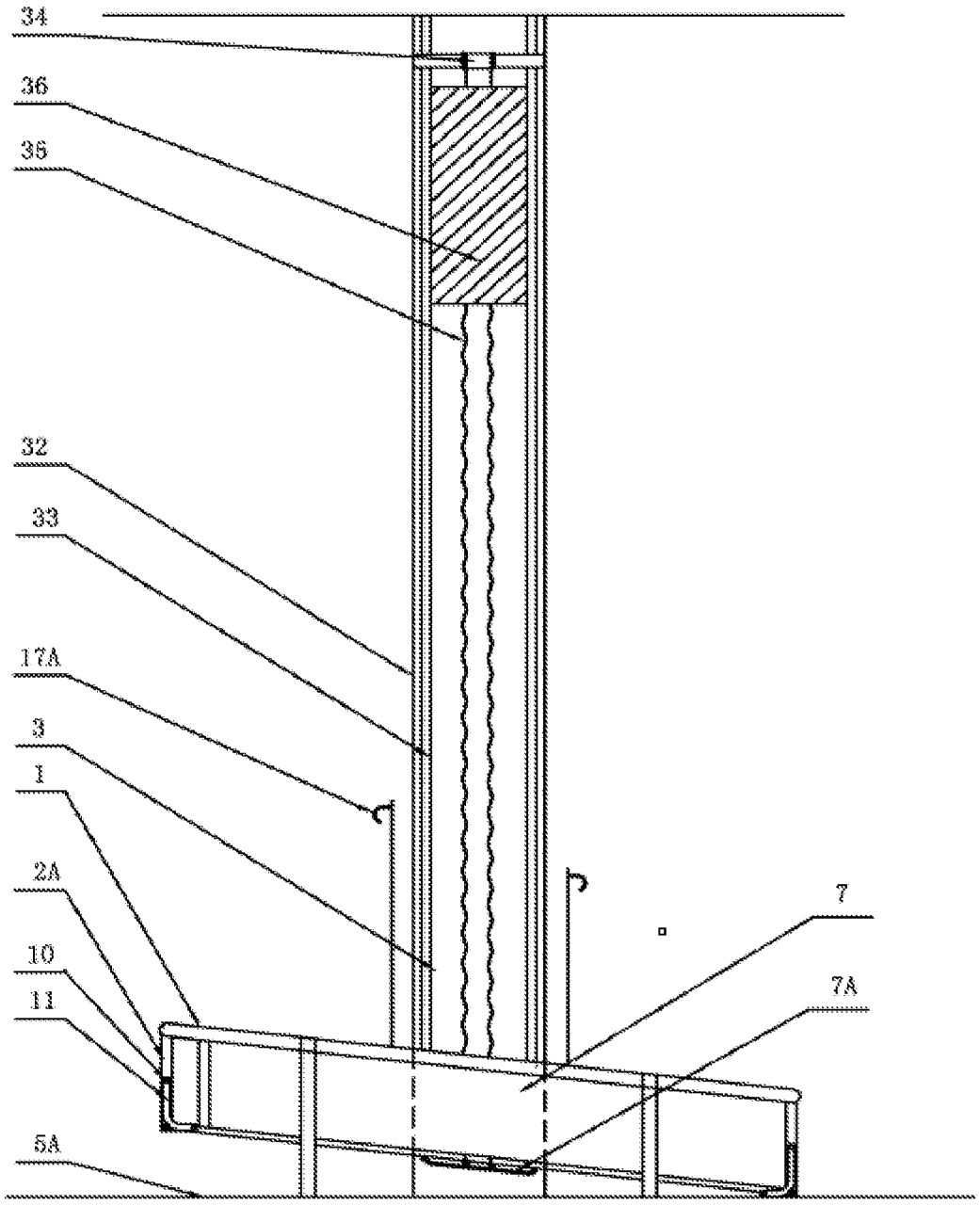
FIG. 20 is a front view of a turning chute lowered to a stair landing by a lifting device in accordance with one embodiment of the invention.
Figure 21:
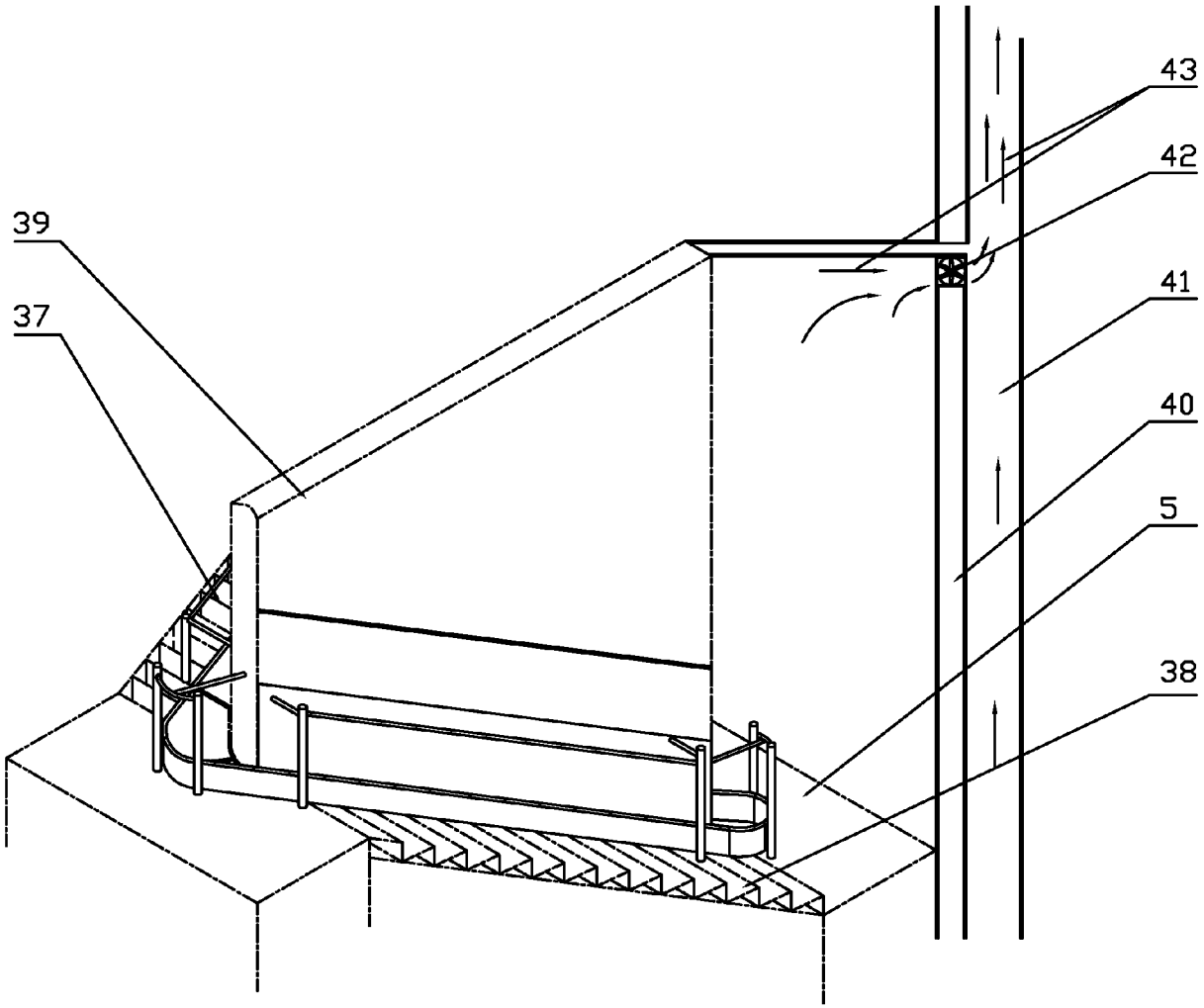
FIG. 21 is front view of a fume vent, fume extraction fan, and a ventilation pipe in accordance with one embodiment of the invention.

As shown in FIGS. 18A, 18B, the chute base 20A of the front section 20 of the turning chute comprises a front part in a rectangular shape and a rear part in a sector shape. A front end of the chute base 20A of the front section 20 is in lap joint with a rear end of the chute base 2 of the upper straight chute and is disposed on a supporting plate 2F arranged on the rear end of the chute base 2 of the upper straight chute. A rear end of the chute base 20A of the front section 20 is in lap joint with an upper end of the chute base 21A of the middle section 21 and is disposed on a supporting plate 21B of the chute base 21A of the middle section 21. The chute base 21A of the middle section 21 comprises: an inner end being in hinge joint with the middle wall via the second rotating axle 8, and a rear end being in hinge joint with a front end of the chute base 22A of the rear section 22. A rear end of the chute base 22A of the rear section 22 is in butt joint with a front end of the chute base 2 of the lower straight chute.

Each hinge joint between the chute bases of corresponding chutes is provided with a hinge roller 8B. Each butt joint and lap joint is provided with a combined pulley 6.

As shown in FIGS. 14-17, the escape chute is also provided with a chute-linked wire rope 27, a laterally positioning wire rope 27A, a sliding hole 27B, a detachable device 27C, and a positioning hole 27D to realize the linkage of the chutes and to tie the guard rails 2A at a straight angle to the corresponding chute bases.

Structures and embodiments of the guard rails 2A are the same those of Example 2, that is, the linkage of the guard rails 2A and functions thereof are realized by using the sliding hole 27B, the detachable device 27C, the positioning hole 27D, and the laterally positioning wire rope 27A.

When the upper straight chute is rotated downwardly, the chute base 20A of the front section 20 of the turning chute slides downwardly along with the supporting plate 2F of the chute base 2 of the upper straight chute and the supporting plate 21B of the chute base 21 of the middle section 21. The chute base 20A of the front section 20 is then located at the guard rail 2A of the middle section 21. Thus, the supporting plate 2F of the upper straight chute and the supporting plate 21B of the middle section 21, thereby forming the lap joint with the upper straight chute and the middle section 21, respectively.

Structures of the guard rails are shown in FIGS. 14-17, 18A, and 18B. The guard rail 2A of the front section 20 comprises: a front part divided into two members of the same shapes and in hinge joint with the rectangular-shaped front chute base; and a rear part in hinge joint with the sector-shaped rear chute base. The upper end of the guard rail 2A of the front section 20 is connected with the guard rail 2A of the upper straight chute, and the lower end of the guard rail 2A of the front section 20 is connected to guard rails of the middle section 21, the rear section 22, and the guard rail of the lower straight chute one after another.

Example 4

The turning chute 7 is provided with a lifting device comprising a lifting slide 32, a balance iron slide 33, a pulley 34, a hanging wire rope 35, and a balance iron 36. One end of the hanging wire rope 35 is fixed on the balance iron 36, and the other end of the hanging wire rope 35 is fixed on the turning chute 7 after passing through the pulley 34. The turning chute 7 comprises a supporting plate 7A on a bottom, and the supporting plate is able to support the turning chute and drive the turning chute to move upwardly and downwardly inside the lifting slide. The balance iron 36 is disposed inside the balance iron slide 33 and is downwardly and upwardly movable in an opposite direction of the movement of the turning chute.

The weight of the balance iron 36 is relatively light to the weight of the turning chute 7. When the upper straight chute is turned downwardly, the supporting plate 7A of the turning chute 7 is removed from being supported by the coupling devices, thereby sliding downwardly at a uniform velocity under the force of the self-gravity and the drag of the balance iron 36. A preferable weight difference between the turning chute 7 and the balance iron 36 is 3 Kg, thereby ensuring that persons will not hurt when they are hit by the descending turning chute. As shown in FIG. 7, the turning chute 7 employs an integrated structure, the lifting device is arranged on the end face of the middle wall for integrally raising or lowering the turning chute. The turning case can be lifted and fixed at a top of the stairway. In case of fire, the turning chute is dragged downwardly by the upper straight chute on the stair landing 5A, and draws the lower straight chute to descend, thus, a continuous escape chute is formed.

Example 5

The escape chute further comprises a fire-proof ventilation device comprising a baffle 39, a ventilation pipe 41, a fume vent, and a fume extraction fan 42. The baffle 39 separates an upper stairway 37 from a lower stairway 38 from a middle position for allowing the fume to rise regularly. The fume vent and the fume extraction fan 42 are disposed on an outer wall of a top of each floor for allowing the fume of an inner side of the wall to communicate with the ventilation pipe 41 arranged on an outer side of the wall. The ventilation pipe 41 is disposed on an outer side of the wall from the top floor to the ground floor. When two ends of the ventilation pipe are open, a strong gas current is produced inside the ventilation pipe and a negative pressure is formed, so that the fume is able to be extracted out from the stairway to the outdoor space through the ventilation pipe while the fume extraction fan is started to work. Once the fume is extracted out, the danger of the fire is largely lowered and is beneficial to the evacuation of people.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An escape chute adapted to be mounted in a plurality of stairways between floors of a building; each of the plurality of stairways being disposed between two adjacent floors; each of the plurality of stairways comprising a wall; the escape chute comprising:

a plurality of wire ropes; each of said plurality of wire ropes comprising a first wire end and a second wire end; and a plurality of straight chutes; each of said plurality of straight chutes comprising:

a chute base;

a first rotating axle;

a guard rail;

a guard plate;

a spring hoop;

a rod having a first rod end and a second rod end;

a second rotating axle; and a handrail having a first handrail end and a second handrail end;

wherein:

each of said plurality of straight chutes is adapted to be disposed in one of the plurality of stairways;

each of said plurality of wire ropes connects between two adjacent straight chutes of said plurality of straight chutes;

said guard plate is adapted to be fixed on the wall;

said chute base is connected to said guard plate via said second rotating axle;

said chute base is connected to said guard rail via said first rotating axle;

said handrail is fixed on said guard rail;

said first handrail end is disposed in a proximity of an upper floor of the two adjacent floors with respect to one of the plurality of stairways;

said second handrail end is disposed in a proximity of a lower floor of the two adjacent floors with respect to one of the plurality of stairways;

said spring hoop in the lower one of the two adjacent straight chutes of said plurality of straight chutes is provided with the rod;

said first wire end is connected to said second handrail end in the upper one of the two adjacent straight chutes of said plurality of straight chutes; and said second wire end is connected to said first rod end.

2. The escape chute of claim 1, wherein a sprinkler pipe is adapted to be disposed on the wall.

3. The escape chute of claim 1, wherein:

each of said plurality of straight chutes comprises: a curved connecting piece having a first piece end and a second piece end, a spring pin, a slide groove, and a positioning recess;

said slide groove is arranged on a side surface of said guard rail along a direction perpendicular to said first rotating axle;

said positioning recess is disposed in said slide groove at a first position farmost from said first rotating axle, and said positioning recess is deeper than said slide groove;

said first piece end is hinged to said chute base; and one end of said spring pin is connected to said curved connecting piece; and an other end of said spring pin is disposed inside said slide groove.

* * * * *